US011745493B2

(12) United States Patent
Zabow

(10) Patent No.: US 11,745,493 B2
(45) Date of Patent: Sep. 5, 2023

(54) ULTRA-CONFORMAL MICROPRINT AND ULTRA-CONFORMAL MICROPRINT TRANSFERRING

(71) Applicant: Government of the United States of America, as represented by the Secretary of Commerce, Gaithersburg, MD (US)

(72) Inventor: Gary Zabow, Boulder, CO (US)

(73) Assignee: GOVERNMENT OF THE THE UNITED STATES OF AMERICA, AS REPRESENTED BY THE SECRETARY OF COMMERCE, Gaithersburg, MD (US)

( * ) Notice: Subject to any disclaimer, the term of this patent is extended or adjusted under 35 U.S.C. 154(b) by 258 days.

(21) Appl. No.: 16/988,017

(22) Filed: Aug. 7, 2020

(65) Prior Publication Data

US 2022/0040970 A1 Feb. 10, 2022

(51) Int. Cl.
*B41M 3/00* (2006.01)
*B41F 19/08* (2006.01)

(52) U.S. Cl.
CPC ..... *B41F 19/08* (2013.01); *B41M 3/00* (2013.01); *B05D 2203/35* (2013.01)

(58) Field of Classification Search
CPC ..... B41M 3/00
See application file for complete search history.

(56) References Cited

U.S. PATENT DOCUMENTS 10,533,080 B2 * 1/2020 Kim ..... B81C 1/00373

OTHER PUBLICATIONS

Carlson, A., et al., "Transfer Printing Techniques for Materials Assembly and Micro/Nanodevice Fabrication", Advanced Materials, 2012, p. 5284-5318, vol. 24.

* cited by examiner

*Primary Examiner* — Dah-Wei D. Yuan
*Assistant Examiner* — Kristen A Dagenais
(74) *Attorney, Agent, or Firm* — Office of Chief Counsel for National Institute of Standards and Technology

(57) ABSTRACT

A process for making an ultra-conformal microprint by ultra-conformal microprint transferring includes: disposing a transfer moiety arranged in a microstructure on a transfer substrate; disposing a glassy transfer layer on the transfer moiety; forming a glassy composite; removing the glassy composite from the transfer substrate while maintaining the microstructure of the transfer moiety in the glassy transfer layer; disposing the glassy composite on a microprint substrate; ultra-conformally covering the microprint substrate with the glassy composite by heating the glassy composite so that it flows while maintaining the microstructure of the transfer moiety in the glassy transfer layer so that the microstructure is disposed on the microprint substrate; and removing the glassy transfer layer while leaving the transfer moiety disposed in the microstructure on the microprint substrate to form the ultra-conformal microprint including the transfer moiety arranged in the microstructure on the microprint substrate.

12 Claims, 18 Drawing Sheets

(A)

(B)

(C)

(A)

(B)

(A)

(B)

(A)

(B)

ULTRA-CONFORMAL MICROPRINT AND ULTRA-CONFORMAL MICROPRINT TRANSFERRING

STATEMENT REGARDING FEDERALLY SPONSORED RESEARCH

This invention was made with United States Government support from the National Institute of Standards and Technology (NIST), an agency of the United States Department of Commerce. The Government has certain rights in the invention. Licensing inquiries may be directed to the Technology Partnerships Office, NIST, Gaithersburg, MD, 20899; voice (301) 975-2573; email tpo@nist.gov.

BRIEF DESCRIPTION

Disclosed is an ultra-conformal microprint composite for making an ultra-conformal microprint by ultra-conformal microprint transferring that includes: a microprint substrate; a glassy composite ultra-conformally disposed on the microprint substrate, the glassy composite including: a glassy transfer layer in a glass state including: corn syrup; and sugar disposed in the corn syrup; and a transfer moiety disposed on the glassy transfer layer and arranged as a microstructure.

Disclosed is a process for making an ultra-conformal microprint by ultra-conformal microprint transferring that includes: disposing a transfer moiety arranged in a microstructure on a transfer substrate; disposing a glassy transfer layer on the transfer moiety; forming a glassy composite comprising the glassy transfer layer and transfer moiety with maintaining the microstructure of the transfer moiety in the glassy transfer layer; removing the glassy composite from the transfer substrate while maintaining the microstructure of the transfer moiety in the glassy transfer layer; disposing the glassy composite on a microprint substrate; ultra-conformally covering the microprint substrate with the glassy composite while maintaining the microstructure of the transfer moiety in the glassy transfer layer so that the microstructure is disposed on the microprint substrate; and removing the glassy transfer layer while leaving the transfer moiety disposed in the microstructure on the microprint substrate to form the ultra-conformal microprint comprising the transfer moiety arranged in the microstructure on the microprint substrate.

BRIEF DESCRIPTION OF THE DRAWINGS

The following description should not be considered limiting in any way. With reference to the accompanying drawings, like elements are numbered alike.

DETAILED DESCRIPTION

Figure 1:
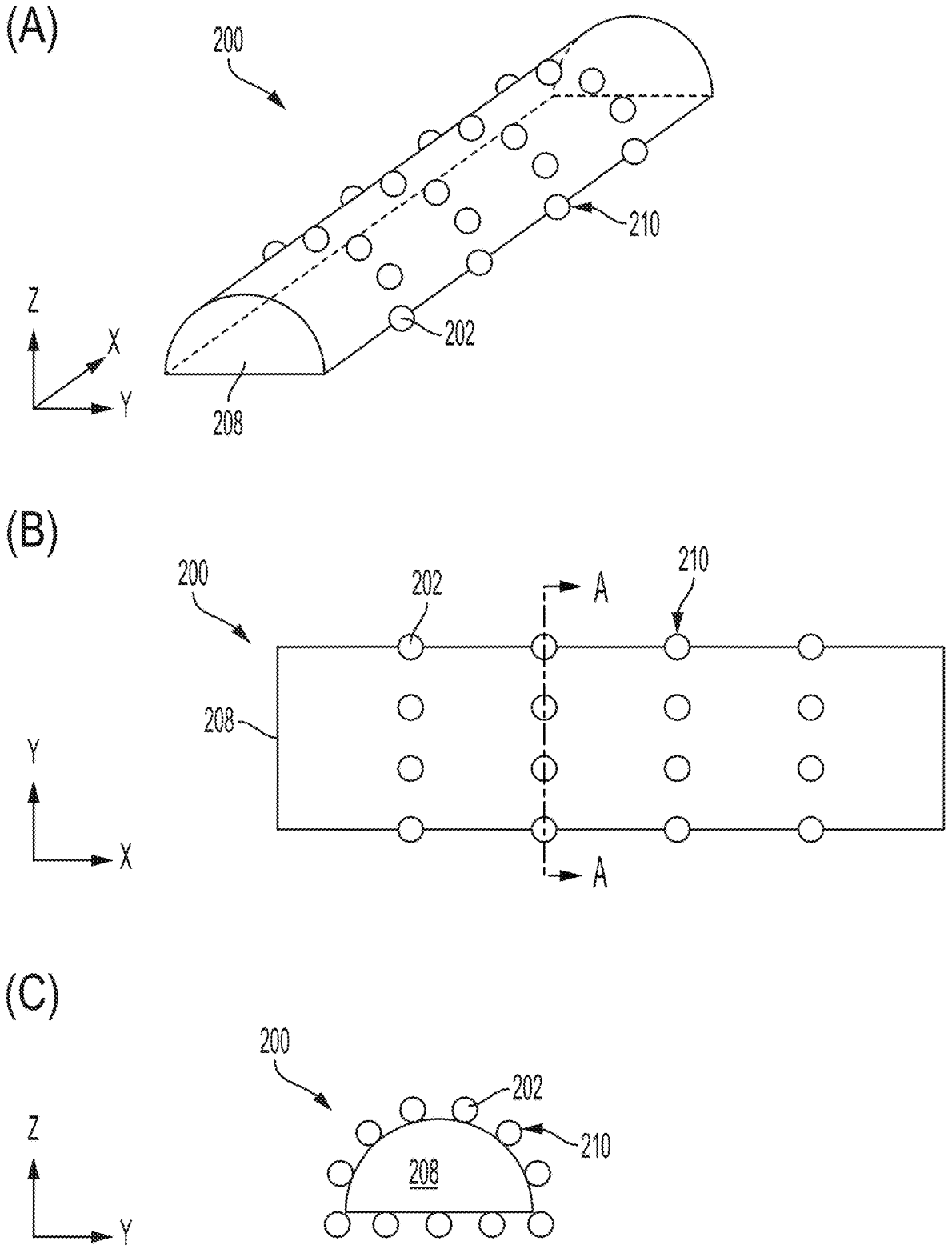
FIG. 1 shows a perspective view of an ultra-conformal microprint in panel A, a plan view of the ultra-conformal microprint in panel B, and a cross-section along line A-A indicated in panel B of the ultra-conformal microprint in panel C.

A detailed description of one or more embodiments is presented herein by way of exemplification and not limitation.

It has been discovered that a ultra-conformal microprint 200 and process for ultra-conformal microprint transferring provides transference of microstructures created on transfer substrate 201 onto a microprint substrate 208, wherein the microprint substrate 208 can be a highly nonplanar (e.g., discontinuous or curved) or incompatible with conventional fabrication processes. The ultra-conformal microprint transferring involves disposing a glassy transfer layer 206 on the transfer substrate 201 and forming a glassy composite 207 that includes transfer moiety 202 disposed in the glassy composite 207. The glassy composite 207 is removed together from the transfer substrate 201 and disposed on the microprint substrate 208. The glassy transfer layer 206 has a glass transition temperature Tg so that the glassy composite 207 can be ultra-conformally disposed on the microprint substrate 208. It is contemplated that ultra-conformal disposal of glassy composite 207 on microprint substrate 208 can cover corners, protuberances, holes, vias, or trenches, disposed on microprint substrate 208. Finally, the glassy transfer layer 206 is miscible in a solvent to be removed from microprint substrate 208 and leave the transfer moiety 202 arranged in a microstructure on microprint substrate 208 as ultra-conformal microprint 200.

Ultra-conformal microprint transferring makes ultra-conformal microprint 200. In an embodiment, with reference to FIG. 1, ultra-conformal microprint 200 includes: a plurality of transfer moiety 202 disposed as microstructure 210 on microprint substrate 208.

Figure 2:
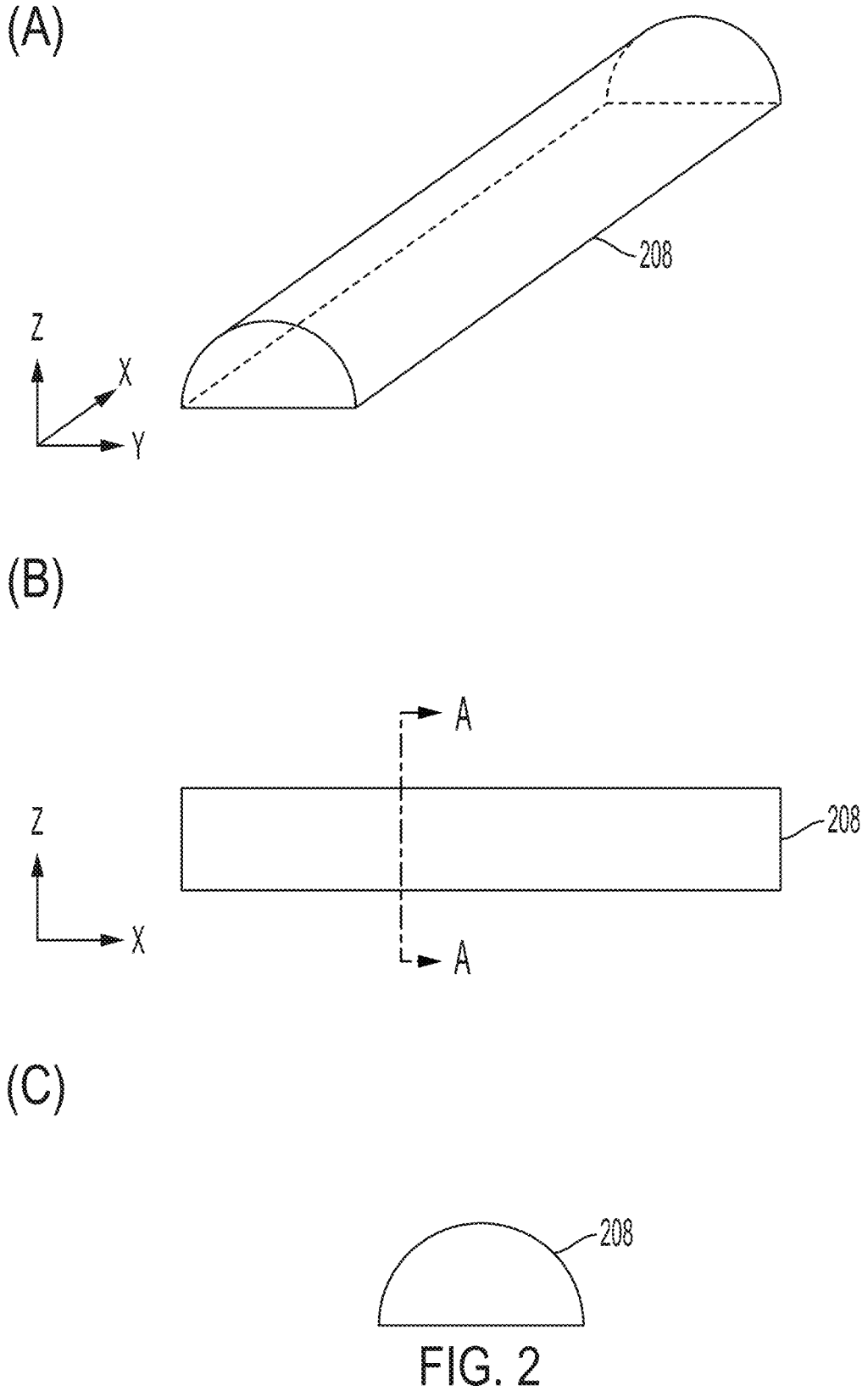
FIG. 2 shows a perspective view of a microprint substrate in panel A, a plan view of the microprint substrate in panel B, and a cross-section along line A-A indicated in panel B of the microprint substrate in panel C.

With reference to FIG. 2, microprint substrate 208 receives glassy composite 207 for transfer of transfer moiety 202 thereon. Microprint substrate 208 can include various materials, e.g., a semiconductor (e.g., silicon and the like including a binary semiconductor, ternary semiconductor, and the like), metal, glass, ceramic, paper, polymer, textile, fiber, biological material (e.g., skin, hair, tissue, organs, and cells), and the like. Exemplary microprint substrates 208 include microfibers, microspheres, and all manner of nonplanar surfaces with high curvatures for which pattern transfer is difficult or impossible via other methods. Microprint substrate 208 can have an arbitrary shape and size. It is contemplated that the shape of microprint substrate 208 can be round, polygonal, irregular, and the like to provide a cross-sectional shape this is symmetric or asymmetric with a selected degree of anisotropy. A surface of microprint substrate 208 can be planar or curved and can have an embossed feature (e.g., a protuberance such as a post or ridge) or recessed feature (e.g., as an aperture, hole, trench and the like), wherein the recessed or embossed feature can have an arbitrary largest linear dimension and arbitrary shortest linear dimension along a radius, length, width, or height of the recessed or embossed feature, as applicable to a geometry of the microprint substrate 208. A largest dimension of microprint substrate 208 can be from 10 nm to 10 m, specifically from 100 nm to 10 cm, and more specifically from 1 μm (also indicated as micron) to 10 mm. Further, microprint substrate 208 can be flexible, hard, or soft, can have rough or smooth surfaces, or can be made from materials incompatible with conventional semiconductor processing. In an embodiment, microprint substrate 208 includes a strand of human hair. In another embodiment, microprint substrate 208 includes a polystyrene microsphere.

Transfer moiety 202 can include various materials, e.g., silicon or other semiconductor materials, metals, glasses, plastics, polymers, pharmaceuticals, dyes and the like. Exemplary transfer moieties 202 include metallic, glass and polymeric microstructures and mixtures thereof, of arbitrary complexity including even fully functional optical or electronic components. Transfer moiety 202 can have an arbitrary shape and size. It is contemplated that the shape of transfer moiety 202 can be round, polygonal, irregular, and the like to provide a cross-sectional shape this is symmetric or asymmetric with a selected degree of anisotropy. Further, transfer moiety 202 can be electrically insulating, semiconductive, or conductive. In an embodiment, transfer moieties 202 are magnetic, ferromagnetic, paramagnetic, nonmagnetic, or a combination thereof. A largest dimension of transfer moiety 202 can be from 1 nm to 10 cm, specifically from 10 nm to 1 cm, and more specifically from 10 nm to 1 mm. Moreover, transfer moiety 202 can be made from materials incompatible with conventional semiconductor processing and can be made from fragile materials, even those that may be too fragile to pick up via conventional methods since the transfer process described here can involve gentle processing. In an embodiment, transfer moiety 202 includes metallic disks, magnetic dots, and ultrathin materials (e.g., as shown in FIG. 13*b*) that are thin and fragile to be not mechanically self-supporting in air, precluding their being picked up and placed onto a substrate by conventional acts or articles.

It should be appreciated that ultra-conformal microprint composite 209 can be formed and used to make ultra-conformal microprint 200. In an embodiment, ultra-conformal microprint composite 209 for making ultra-conformal microprint 200 by ultra-conformal microprint transferring includes: microprint substrate 208; glassy composite 207 ultra-conformally disposed on microprint substrate 208, glassy composite 207 including: glassy transfer layer 206 in a glass state including: corn syrup; and sugar disposed in the corn syrup; and transfer moiety 202 disposed on, or embedded in surface of glassy transfer layer 206 and arranged as microstructure 210.

Transfer moiety 202 are disposed on microprint substrate 208 and arranged in microstructure 210. The arrangement of transfer moieties can provide properties of microstructure 210 or ultra-conformal microprint 200 or modifying properties of microprint substrate 208. Exemplary microstructures 210 include selected arrangements of metallic wires that can include electronic circuitry or spatially periodic arrays of transfer moieties whose materials and spatial arrangements might endow special optical, mechanical, or metamaterial properties to the microprint substrate, or might provide special surface textures that might impart particular hydrophobicities or other particular chemical functionalities to the microprint substrate hydrophobic. A largest dimension of microstructure 210 can be from 10 nm to 10 m, specifically from 100 nm to 10 cm, and more specifically from 1 micron to 10 mm. Moreover, microstructure 210 can include individual or spatially arranged arrays of complex prefabricated optical or electronic components. In an embodiment, microstructure 210 includes arrays of gold and of magnetic particles.

Figure 3:
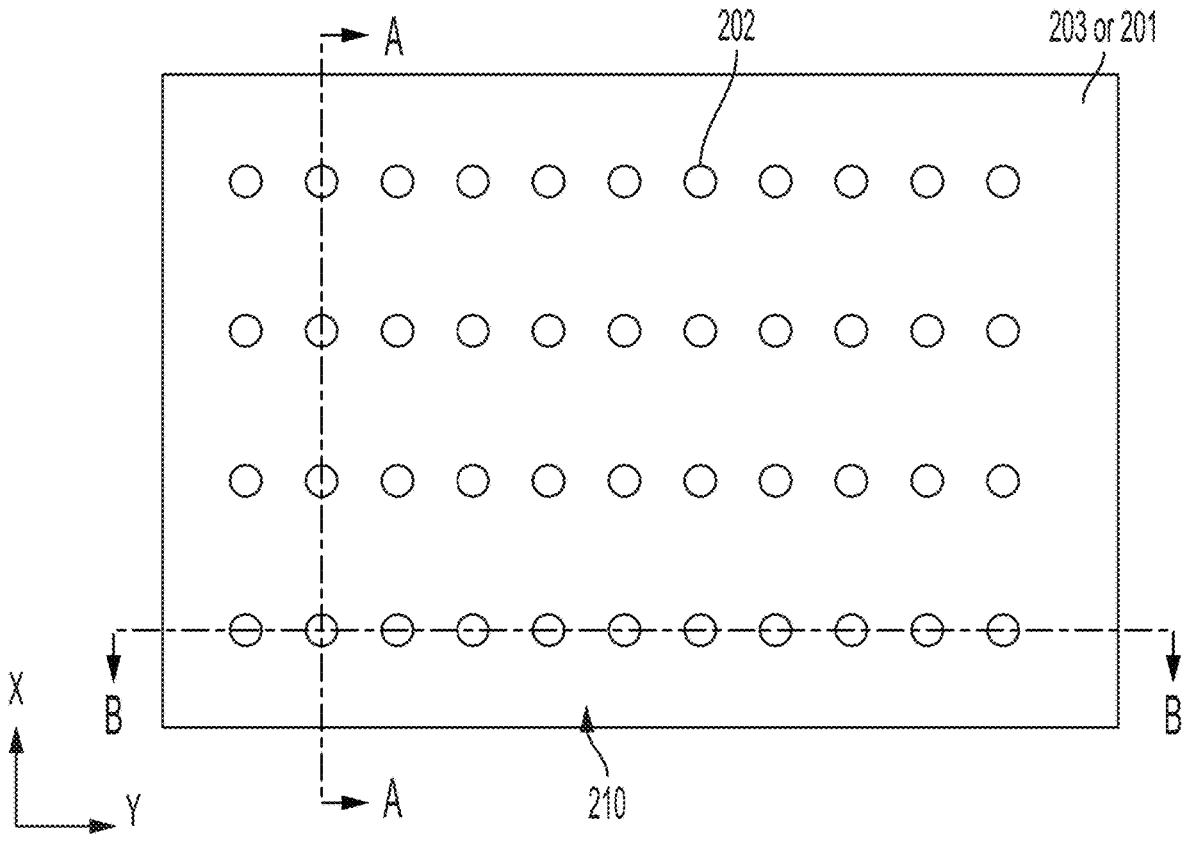
FIG. 3 shows a plan view of a plurality of transfer moieties disposed on a sacrificial layer or on a transfer substrate with the transfer moieties arranged as a microstructure.
Figure 4:
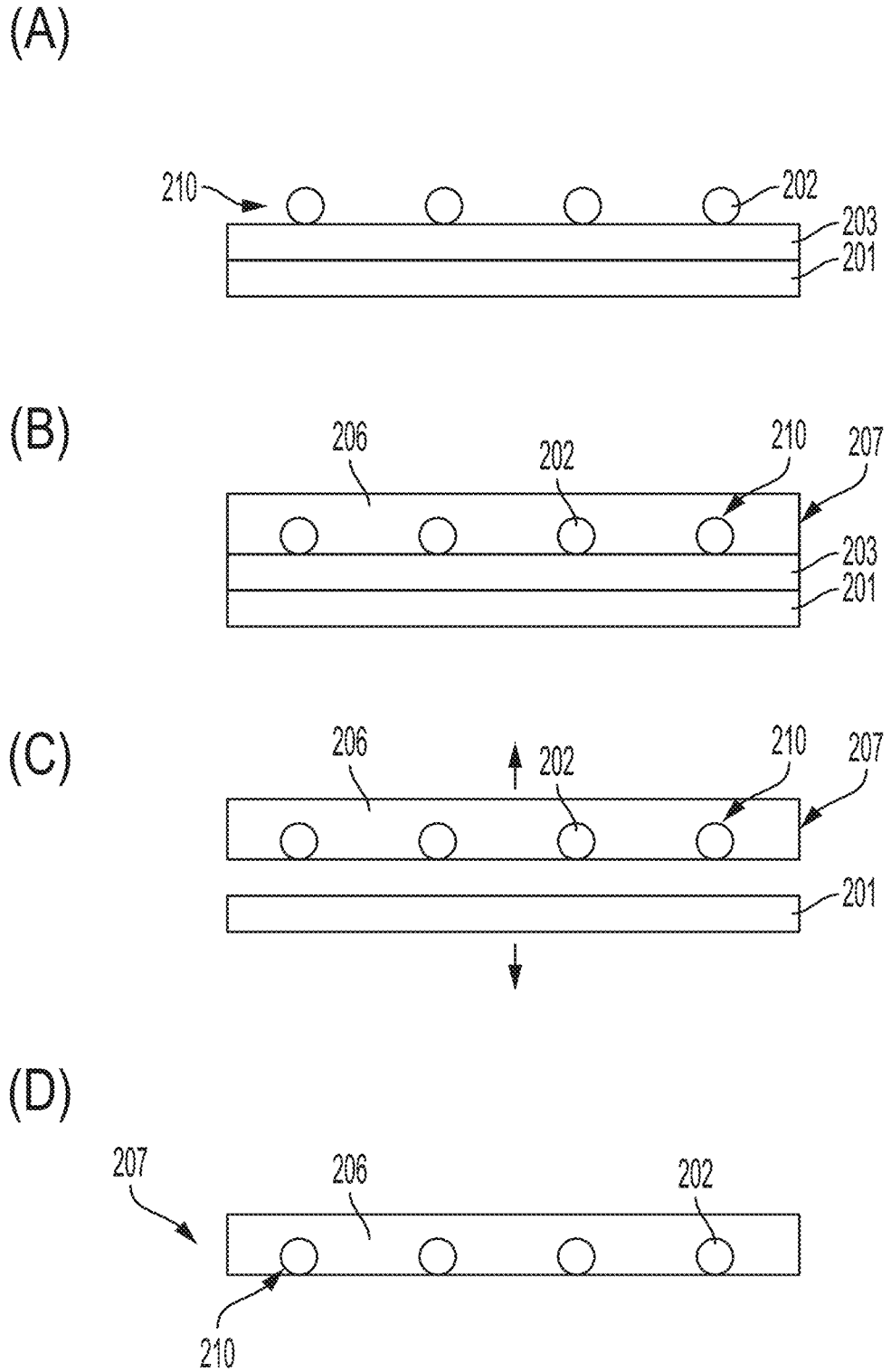
FIG. 4 shows, in panel A, a cross-section along line A-A of the article shown in FIG. 3 for transfer moieties disposed on the sacrificial layer, a glassy composite disposed on the sacrificial layer in panel B, removal of sacrificial layer for separation of the transfer substrate from the glassy composite in panel C, and the glassy composite removed from the transfer substrate in panel D.
Figure 8:
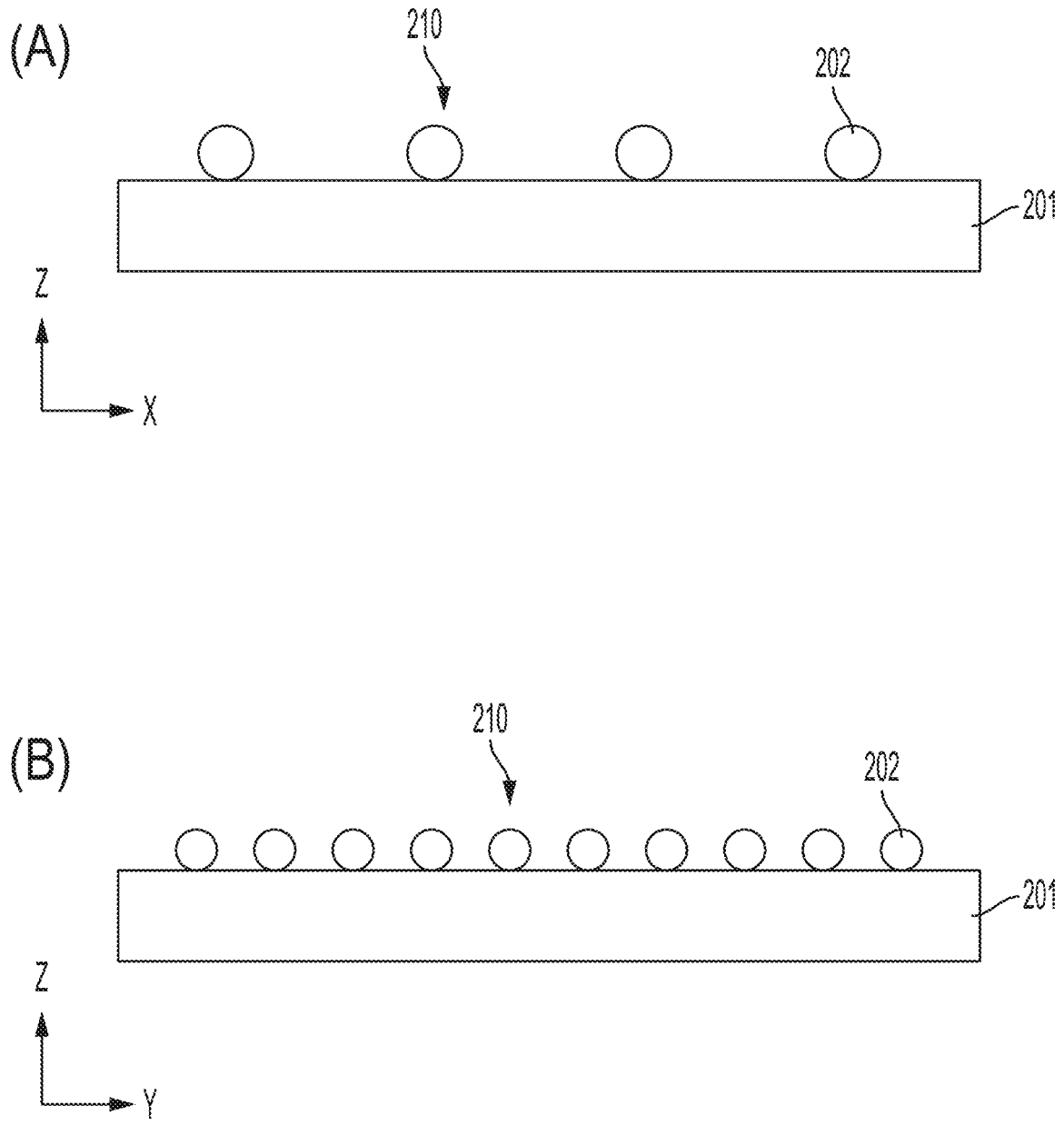
FIG. 8 shows, in panel A, a cross-section along line A-A of the article shown in FIG. 3 for transfer moieties disposed on the transfer substrate, and panel B shows a cross-section along line B-B of the article shown in FIG. 3 for transfer moieties disposed on the transfer substrate.
Figure 9:
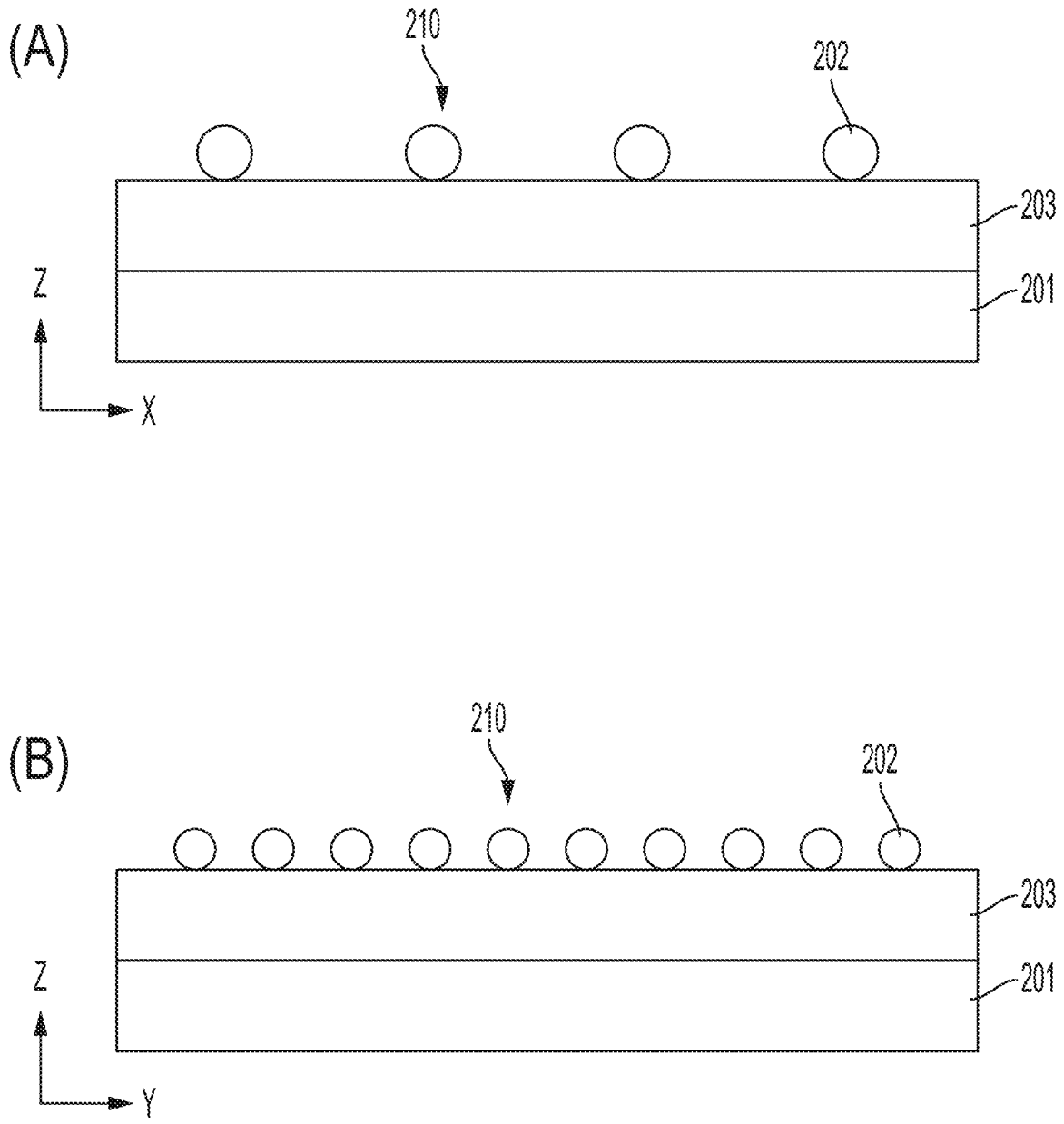
FIG. 9 shows, in panel A, a cross-section along line A-A of the article shown in FIG. 3 for transfer moieties disposed on a sacrificial layer on the transfer substrate, and panel B shows a cross-section along line B-B of the article shown in FIG. 3 for the transfer moieties disposed on a sacrificial layer on the transfer substrate.
Figure 10:
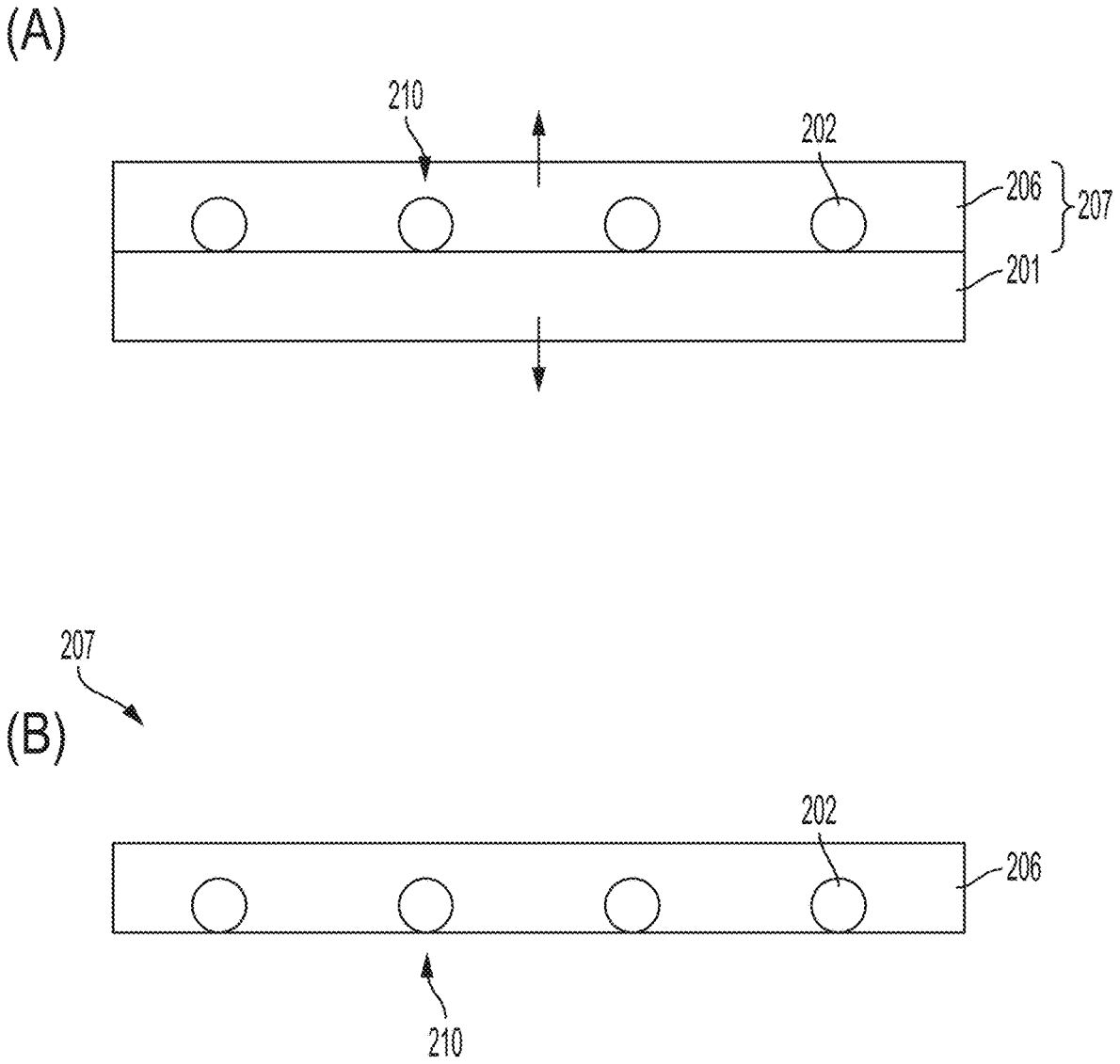
FIG. 10 shows a cross-section of a glassy composite formed by disposal of a glassy transfer layer to embed the transfer moiety in the glassy transfer layer starting with transfer moiety disposed on the transfer substrate in accord with the article shown in FIG. 8, and panel B shows the glassy composite removed from the transfer substrate.
Figure 11:
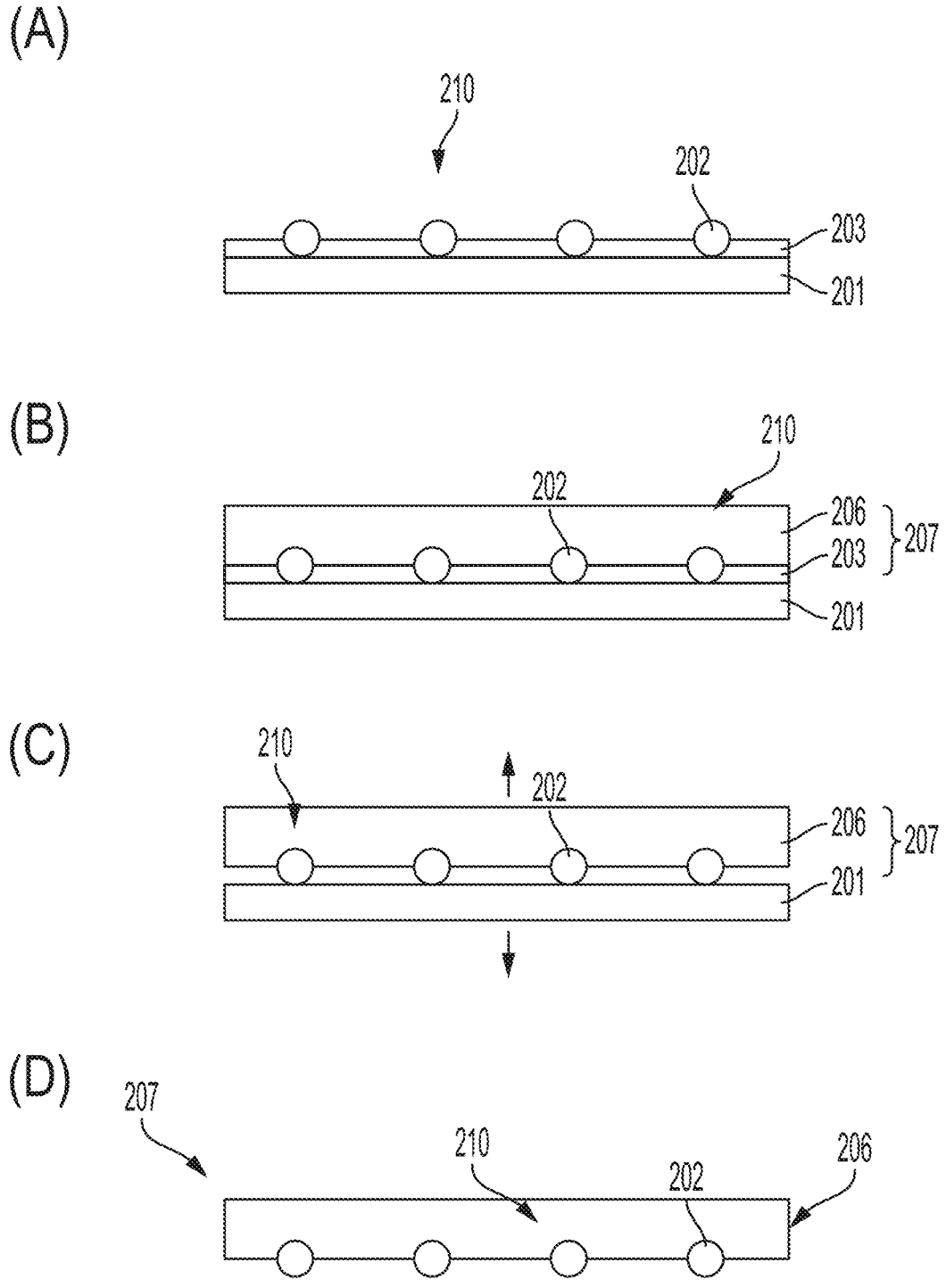
FIG. 11 shows, in panel A, a cross-section along line A-A of the article shown in FIG. 3 for transfer moieties disposed on the transfer substrate and disposed in sacrificial layer, a glassy composite disposed on the sacrificial layer in panel B, removal of sacrificial layer for separation of the transfer substrate from the glassy composite in panel C, and the glassy composite removed from the transfer substrate in panel D.

Ultra-conformal microprint 200 can be made in various ways. In an embodiment, with reference to FIG. 3, FIG. 4, FIG. 5, FIG. 6, FIG. 7, FIG. 8, FIG. 9, FIG. 10, FIG. 11, and FIG. 12, a process for making ultra-conformal microprint 200 by ultra-conformal microprint transferring includes: disposing transfer moiety 202 arranged in microstructure 210 on transfer substrate 201 (e.g., FIG. 3, FIG. 8); disposing glassy transfer layer 206 on transfer moiety 202 (e.g., FIG. 4, FIG. 10, FIG. 11); forming glassy composite 207 comprising glassy transfer layer 206 and transfer moiety 202 with maintaining microstructure 210 of transfer moiety 202 in glassy transfer layer 206 (e.g., FIG. 4, FIG. 10, FIG. 11); removing glassy composite 207 from transfer substrate 201 while maintaining microstructure 210 of transfer moiety 202 in glassy transfer layer 206 (e.g., FIG. 4, FIG. 10, FIG. 11); disposing glassy composite 207 on microprint substrate 208 (e.g., FIG. 5, FIG. 12); ultra-conformally covering microprint substrate 208 with glassy composite 207 while maintaining microstructure 210 of transfer moiety 202 in glassy transfer layer 206 so that microstructure 210 is disposed on microprint substrate 208 (e.g., FIG. 5, FIG. 6, FIG. 7, FIG. 12); and removing glassy transfer layer 206 while leaving transfer moiety 202 disposed in microstructure 210 on microprint substrate 208 to form ultra-conformal microprint 200 including transfer moiety 202 arranged in microstructure 210 on microprint substrate 208 (e.g., FIG. 1, FIG. 5, FIG. 12).

Figure 13:
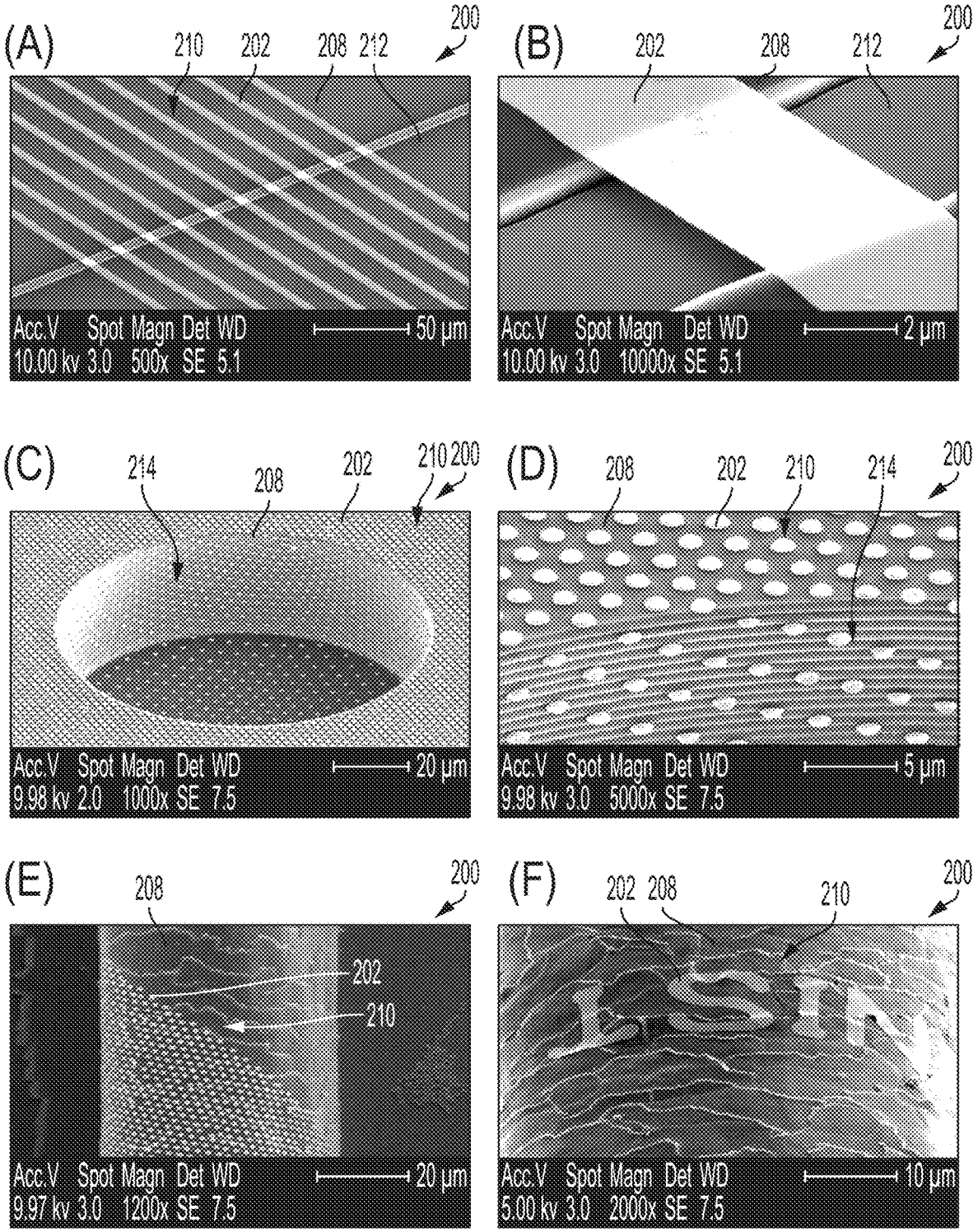
FIG. 13 shows, in panel A, an ultra-conformal microprint that includes a plurality of gold strips disposed as transfer moieties over a trench on a microprint substrate; panel B shows a zoomed view of the ultra-conformal microprint shown in panel A; panel C shows an ultra-conformal microprint that includes a plurality of magnetic dots disposed as transfer moieties in a recessed feature on a microprint substrate; panel D shows a zoomed view of the ultra-conformal microprint shown in panel C; panel E shows an ultra-conformal microprint that includes a plurality of metallic dots disposed as transfer moieties on a hair strand as a microprint substrate; and panel F shows an ultra-conformal microprint that includes a plurality of letters made from thin layers of metal disposed as transfer moieties on a hair strand as a microprint substrate.
Figure 14:
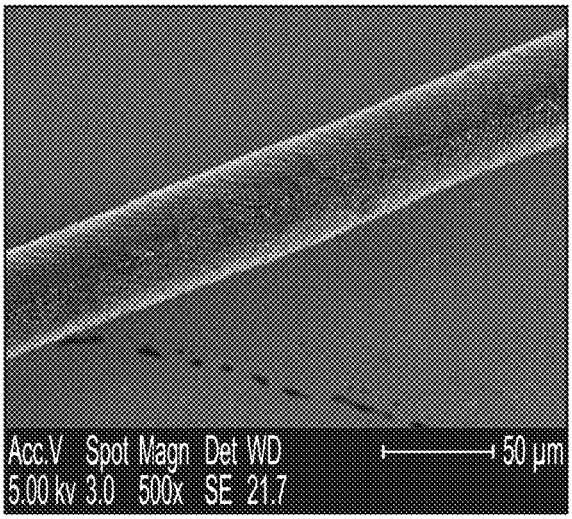
FIG. 14 shows full wraparound covering of a hair with gold dots.
Figure 14:
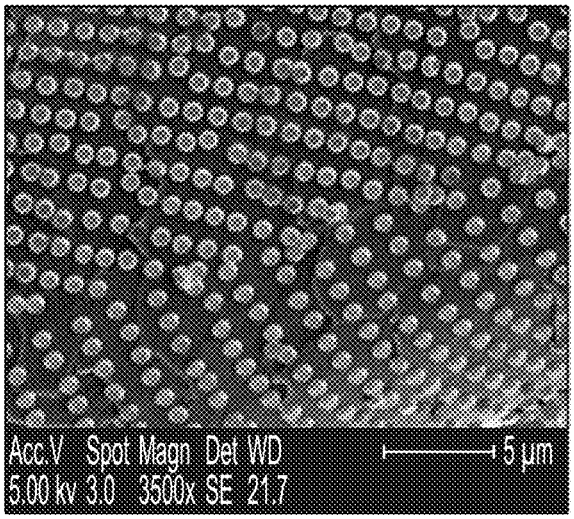

As used herein, "maintaining" the microstructure implies that the geometrical patterning and spacing between the moieties comprising the microstructure are unaltered until they are placed in contact with the microprint substrate when they either remain unaltered, or if transferred to a microprint substrate of different surface profile to that of the transfer substrate or sacrificial layer, such that stretching or compressing is required to accommodate the new surface profile, that the majority of the relative spatial orderings between moieties compromising the microstructure remains unaltered even as the physical spacing between those moieties may locally shrink or expand by locally differing amounts (e.g., as per FIG. 13 *c* where the ordering is maintained even though the spacing between moieties is locally increased to accommodate the increased total surface area of the microprint substrate arising from the extra area introduced by the vertical walls of the recessed feature 214).

In the process for ultra-conformal microprint transferring, disposing transfer moiety 202 arranged in microstructure 210 on transfer substrate 201 or sacrificial layer 203 includes microfabricating transfer moieties 202 directly onto transfer substrate 201 or sacrificial layer 203 in microstructure 210; manually or robotically placing transfer moieties onto the transfer substrate 201 or sacrificial layer 203; self-assembling prefabricated transfer moieties into microstructure 210 on transfer substrate 201 or sacrificial layer 203; or depositing transfer moieties formed via a chemical precipitation reaction or a direct chemical reaction with the transfer substrate. The transfer substrate can be chemically functionalized for formation of the microstructure thereon. In some embodiments, transfer moieties and microstructure are formed by subtractive removing of material in certain locations from a surface layer of the transfer substrate to leave behind a transfer moiety in a microstructure.

Disposing glassy transfer layer 206 on transfer moiety 202 can include: dissolving the glassy transfer layer in a solvent to obtain a liquid form that is poured or spin coated over the transfer substrate 201 or sacrificial layer 203 including transfer moieties, or into which the transfer substrate may be dip coated, and subsequently evaporating the solvent, optionally with heating provided to accelerate, to solidify the glassy transfer layer; softening a solid glassy transfer layer, mechanically pressing or stretching it over the transfer substrate; or heating the glassy transfer layer so that it can be flowed over the transfer substrate without any added solvent and allowing to cool and solidify.

Forming glassy composite 207 includes disposing glassy transfer layer over transfer moieties or solidifying glass transfer layer around transfer moieties.

Removing glassy composite 207 from transfer substrate 201 while maintaining microstructure 210 of transfer moiety 202 in glassy transfer layer 206 includes dissolving sacrificial layer 203 with a solvent that dissolves the sacrificial layer but not the glassy composite layer, or when in an absence of sacrificial layer 203, mechanically peeling or delaminating the glassy composite layer off of the transfer substrate.

Disposing glassy composite 207 on microprint substrate 208 includes placing the glassy transfer layer on of the microprint substrate or placing the microprint substrate on top of the glassy transfer layer. A spacer can support a side of the glassy transfer layer to aid in subsequent ultra-conformal covering.

Ultra-conformally covering microprint substrate 208 with glassy composite 207 includes increasing the temperature to or greater than glass transition temperature Tg of the glassy composite such that it softens flows over the microprint substrate. A spacer can be used to proceed processing directionally from one side of the microprint substrate to the other. The process can be performed under partial or complete vacuum to remove gas that can be present in a recess in the microprint substrate. The composition of the glassy composite can have a reduced vapor pressure to avoid bubbling, or a partial vacuum can be used to remove gas before returning to atmospheric pressure to avoid bubbling. As used herein, ultra-conformal (and variants thereof, including ultra-conformally) refers to disposition of a material onto microprint substrate 208 that can include a sharp-cornered recessed or embossed feature, corner, edge, curved surface, and the like, wherein the disposition of the material proceeds at all surfaces of microprint substrate 208 to provide a ultra-conformal layer with physical characteristics that lack gaps or voids that have a volume larger than $10^{-6}$ $\mu m^3$ within the bulk phase of the ultra-conformal layer. The ultra-conformal layer can have a uniform thickness or non-uniform thickness at any surface of the ultra-conformal layer. Ultra-conformal layers can have a uniform composition throughout the layer or may have a composition that varies through all or a portion of the layer, based on a composition of the glassy transfer layer 206 and transfer moiety 202 disposed in the glassy composite 207. Ultra-conformal surface covering can be advantageous for surfaces or surface features that have sharp angles or locally high curvatures that may have radii of curvature of less than 10 micron, less than 1 micron, or less than 0.1 micron.

Removing glassy transfer layer 206 while leaving transfer moiety 202 disposed in microstructure 210 on microprint substrate 208 to form ultra-conformal microprint 200 includes dissolving the glassy transfer layer in a solvent that does not dissolve the transfer moieties and does not dissolve the microprint substrate. In one embodiment this solvent may be water, allowing a non-toxic and chemically gentle process that enables microprint transferal of mechanically or chemically fragile transfer moieties or transferal onto fragile microprint substrates that can include a living biological surface.

In an embodiment, with reference to, e.g., FIG. 3, FIG. 4, FIG. 9, and FIG. 11, the process for ultra-conformal microprint transferring further includes forming sacrificial layer 203 on transfer substrate 201 prior to disposing transfer moiety 202 and glassy transfer layer 206 on transfer substrate 201 by spin coating a sacrificial material such as photoresist onto the transfer substrate; disposing transfer moiety 202 arranged in microstructure 210 on sacrificial layer 203 by microfabrication on the sacrificial layer; and forming glassy composite 207 on sacrificial layer 203 to form glassy composite 207 on sacrificial layer 203 such that sacrificial layer 203 is interposed between transfer substrate 201 and glassy transfer layer 206 by steps performed in absence of a sacrificial layer.

In an embodiment, with reference to, e.g., FIG. 3, FIG. 4, FIG. 9, and FIG. 11, the process for ultra-conformal microprint transferring further includes removing sacrificial layer 203 to separate glassy composite 207 from transfer substrate 201 prior to removing glassy composite 207 from transfer substrate 201 while maintaining microstructure 210 of transfer moiety 202 in glassy transfer layer 206 by using acetone to dissolve a photoresist sacrificial layer when using a sugar-based glassy layer that is insoluble in acetone.

In an embodiment, the process for ultra-conformal microprint transferring further includes contacting sacrificial layer 203, while disposed on transfer substrate 201, with a first solvent that removes sacrificial layer 203 to separate glassy composite 207 from transfer substrate 201 by soaking the transfer substrate together with the sacrificial and glassy layers in a container with the solvent, wherein glassy transfer layer 206 is immiscible in the first solvent. In an embodiment, the process for ultra-conformal microprint transferring further includes contacting glassy transfer layer 206, while disposed on microprint substrate 208, with a second solvent that removes glassy transfer layer 206 from microprint substrate 208 and leaves transfer moiety 202 disposed in microstructure 210 on microprint substrate 208 by soaking the microprint substrate together with the glassy transfer layer in a solvent that dissolves the glassy transfer layer but does not dissolve the transfer moieties or the microprint substrate.

Figure 5:
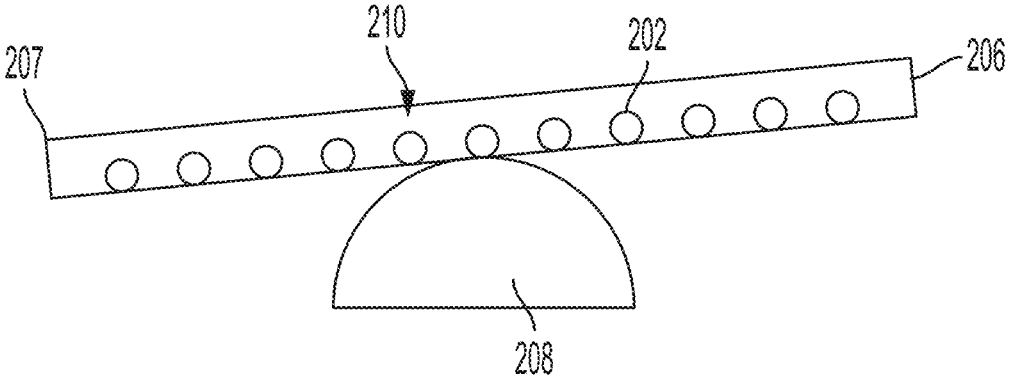
FIG. 5 shows a glassy composite partially disposed on microprint substrate in panel A, partial ultra-conformal disposition of glassy composite on microprint substrate in panel B. and ultra-conformal disposition of glassy composite on microprint substrate to form ultra-conformal microprint composite in panel C.
Figure 5:
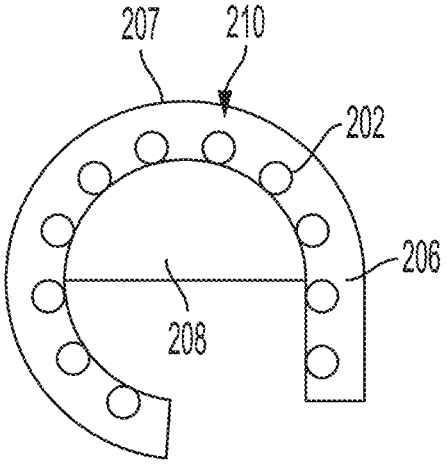
Figure 5:
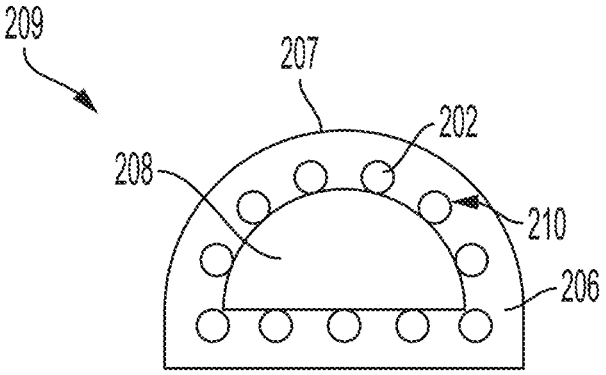
Figure 6:
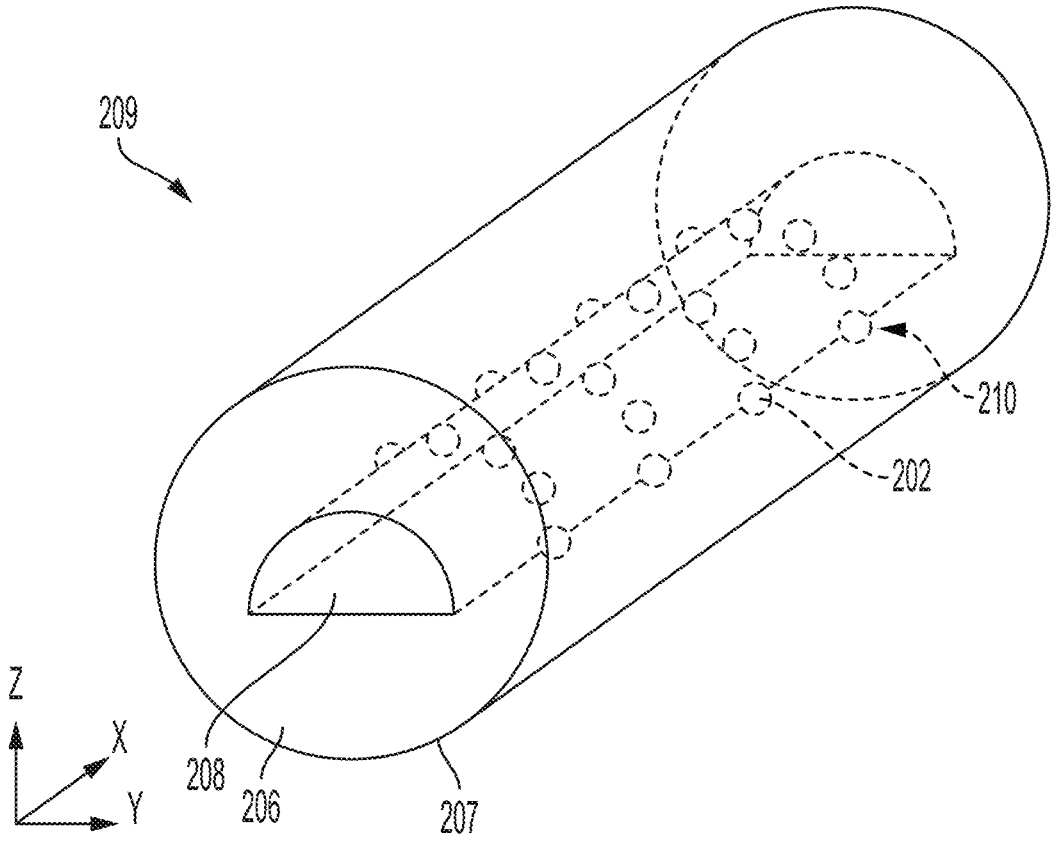
FIG. 6 shows a perspective view of an ultra-conformal microprint composite before removal of the glassy transfer layer to form the ultra-conformal microprint shown in FIG. 1.
Figure 7:
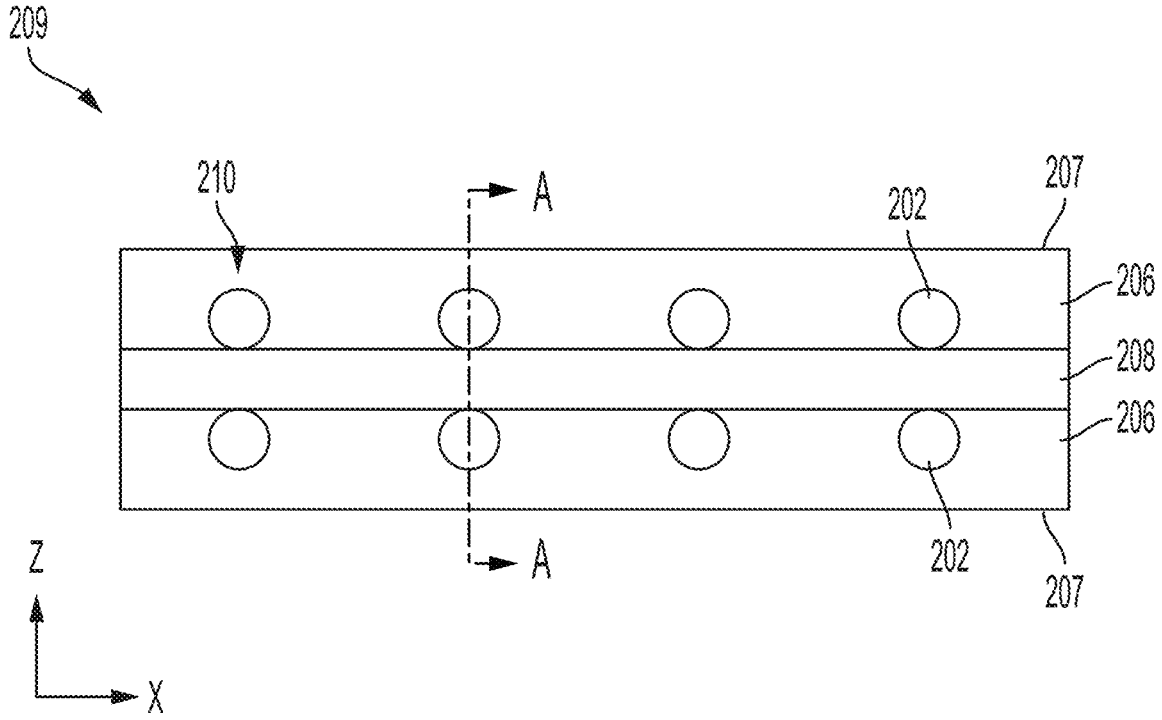
FIG. 7 shows a longitudinal cross-section of the ultra-conformal microprint composite shown in FIG. 6 before removal of the glassy transfer layer to form the ultra-conformal microprint shown in FIG. 1.
Figure 12:
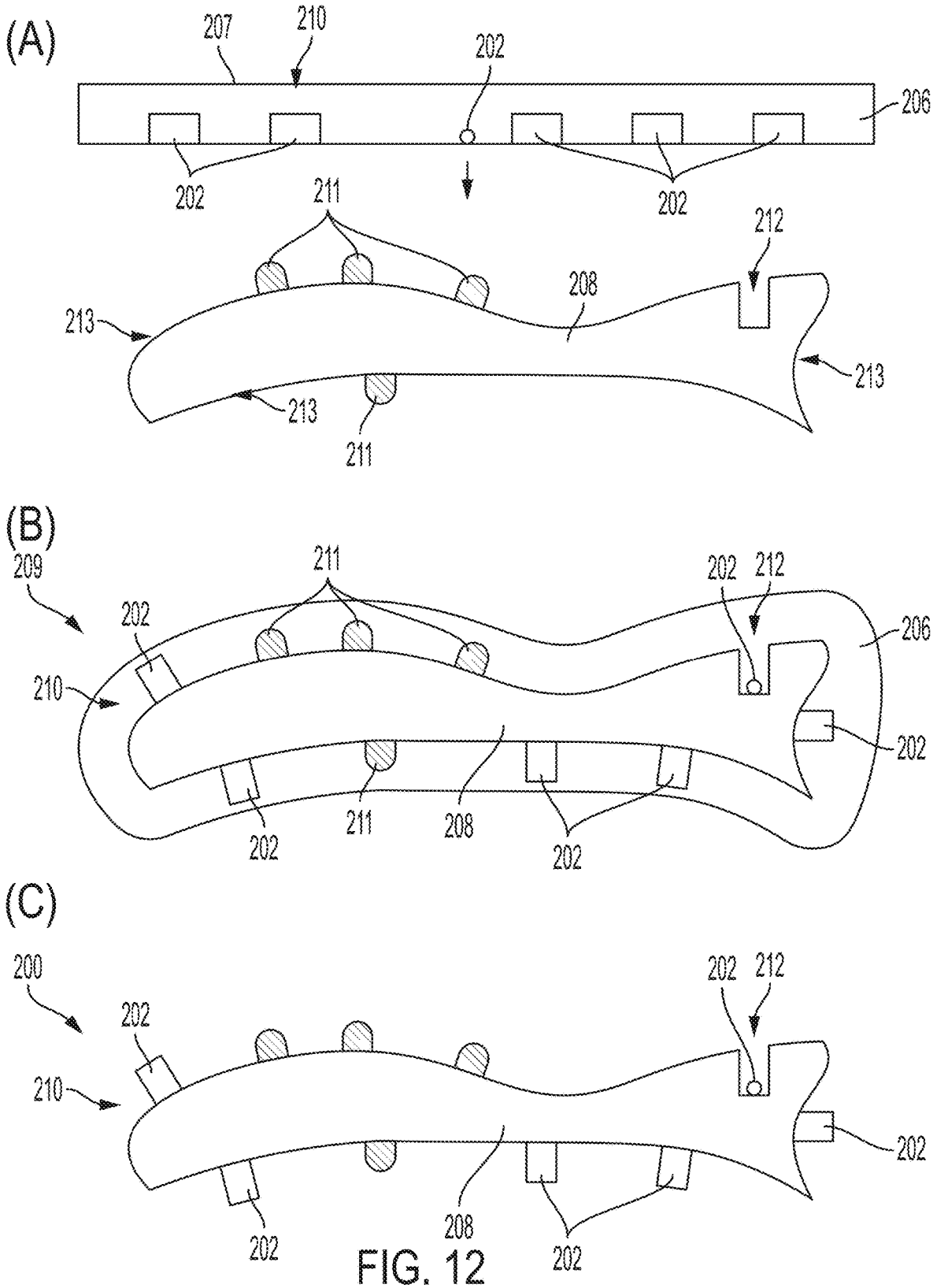
FIG. 12 shows, in panel A, a microprint substrate having an arbitrary shape with a plurality of curved surfaces and a trench on which is disposed a plurality of native moieties and that receives disposition of glassy composite; panel B shows ultra-conformal disposition of glassy composite on microprint substrate to form ultra-conformal microprint composite; and in panel C ultra-conformal microprint after removal of glassy composite from microprint substrate.

In an embodiment, with reference to, e.g., FIG. 5 and FIG. 12, the process for ultra-conformal microprint transferring further includes heating glassy transfer layer 206 to flow glassy transfer layer 206 onto microstructure 210 to form glassy composite 207 on transfer substrate 201 by placing the transfer substrate on a hotplate or in an oven or in a vacuum oven or with a heat gun. In an embodiment, the process for ultra-conformal microprint transferring further includes heating glassy composite 207 to flow glassy transfer layer 206 with transfer moiety 202 on microprint substrate 208 to ultra-conformally cover glassy composite 207 on the microprint substrate 208 by placing the microprint substrate on a hotplate or in an oven or in a vacuum oven or using a heat gun. To avoid cracking of glassy transfer layer on cooling, a controlled slow cooling can be performed.

In an embodiment, a process for ultra-conformal microprint transferring to make ultra-conformal microprint 200 includes spin coating a material that is immiscible in water but miscible in some other solvent and that forms sacrificial layer 203 on transfer substrate 201 (e.g., a silicon wafer). The sacrificial layer 203 can be, e.g., a hard-baked photoresist that is soluble in acetone. On sacrificial layer 203, microstructure 210 of transfer moiety 202 are disposed, e.g., by a procedure that does not destroy sacrificial layer 203. A composition for glassy transfer layer 206 that includes water and sugar is poured over sacrificial layer 203 and transfer substrate 201 and cured by heating glassy transfer layer 206 to evaporate water from glassy transfer layer 206 to form glassy composite 207 disposed on sacrificial layer 203, wherein glassy composite 207 is insoluble in acetone but is water soluble. Transfer substrate 201 with sacrificial layer 203 and glassy composite 207 are contacted with acetone to remove sacrificial layer 203 from transfer substrate 201 and glassy composite 207 without dissolving glassy composite 207 in which remain disposed transfer moiety 202 arranged as microstructure 210. Glassy composite 207 is disposed on microprint substrate 208 with microstructure 210 in contact with microprint substrate 208. Optionally, glassy composite 207 is heated above glass transition temperature Tg of glassy transfer layer 206 but below a temperature for destruction of microstructure 210, transfer moiety 202, or microprint substrate 208 so that glassy transfer layer 206 ultra-conformally flows around microprint substrate 208 to form ultra-conformal microprint composite 209. It is contemplated that glassy transfer layer 206 ultra-conformally enters and coats a recess, through hole, blind hole, and the like in microprint substrate 208. Heating can be performed in a vacuum to avoid trapped air that could prevent glassy composite 207 from being disposed in the recess. Ultra-conformal microprint composite 209 is contacted with solvent, e.g., water, to remove glassy transfer layer 206 from microprint substrate 208 and leave microstructure 210 on transfer moiety 202 to form ultra-conformal microprint 200.

A composition for glassy transfer layer 206 can be prepared by combining sugar, corn syrup, and water, heating the composition to caramelization, and cooling the composition to form the material to be used for forming the glassy transfer layer 206. A ratio of components in glassy transfer layer 206 can be varied to provide a selectively tailored glass transition temperature Tg of glassy transfer layer 206. An exemplary composition includes sugar:corn syrup:water in a 2:1:1 ratio by volume, heated until golden brown, and cooled. The resulting solid can be dissolved in water (e.g., 1:1 solid:water by volume) to obtain a liquid form of the material that can easily envelop the transfer moieties and be used to form, after water evaporation, the solid glassy composite 207. Without wishing to be bound by theory, it is believed that while unadulterated sugar can be melted, unadulterated sugar crystallizes into a non-smooth material that can transfer large, macro-sized structures of transfer moiety 202 but that can affect precision of pattern transfer of microstructure 210. Inclusion of corn syrup in glassy transfer layer 206 prevents crystallization of sugar to provide a smooth composition. The composition for making glassy transfer layer 206 can include sugar, corn syrup, or other glassy materials that have low glass transition temperatures. The glassy material can be dissolved in water but that does not dissolve in solvents (e.g., acetone) that are used to dissolve sacrificial layer 203. Further, sacrificial layer 203 can be a photoresist or another material that does not dissolve in water but that dissolves in some other solvent in which glassy transfer layer 206 does not dissolve.

In an embodiment, a process for making ultra-conformal microprint 200 by ultra-conformal microprint transferring includes forming microstructure 210 including transfer moiety 202 on sacrificial layer 203 that optionally can be disposed on transfer substrate 201. Glassy transfer layer 206 is disposed on microstructure 210 to form glassy composite 207, and sacrificial layer 203 is dissolved in a first solvent. Glassy composite 207 is disposed on microprint substrate 208. Contact of glassy composite 207 with microprint substrate 208 can be increased by heating glassy composite 207 to a temperature greater than glass transition temperature Tg of glassy transfer layer 206 such that the glassy transfer layer 206 reflows to ultra-conformally cover microprint substrate 208. By ultra-conformally covering microprint substrate 208 with glassy composite 207, microstructure 210 is disposed on microprint substrate 208 maintaining the configuration of microstructure 210 as formed on sacrificial layer 203 even when microprint substrate 208 has a highly non-planar surface that can include local areas of high curvature that are too high in curvature to be conformally coated by a mechanically less compliant transfer material than glassy transfer layer 206. By exceeding a glass transition point of glassy transfer layer 206, glassy composite 207 flows ultra-conformally to fully conform to whatever container or surface on which glassy composite 207 is disposed. By slowing increasing a temperature of glassy composite 207 to become greater than glass transition temperature Tg, microstructure 210 in glassy composite 207 moves with glassy transfer layer 206 so that microprint substrate 208 is ultra-conformally coated. Following ultra-conformal disposition of glassy composite 207 on microprint substrate 208, glassy transfer layer 206 is cooled below glass transition temperature Tg and solidifies as a glass after which glassy composite 207 is contacted with a solvent to dissolve glassy transfer layer 206 to remove glassy transfer layer 206 from microprint substrate 208 and leave microstructure 210 on microprint substrate 208 as ultra-conformal microprint 200. To avoid cracking of glassy transfer layer 206 during cooling, a cooling rate can be controlled at a selected rate.

It is contemplated that the first solvent for removal of sacrificial layer 203 from glassy transfer layer 206 and the second solvent for removal of glassy transfer layer 206 from microprint substrate 208 are selected such that the first solvent dissolves sacrificial layer 203 but not glassy transfer layer 206, and the second solvent dissolves glassy transfer layer 206. In addition, if glassy transfer layer 206 is in a liquid state for disposal on microstructure 210 on sacrificial layer 203 or transfer substrate 201, the solvent, e.g., water, in the liquid composition for glassy transfer layer 206 does not dissolve sacrificial layer 203.

In an embodiment, native moiety 211 is disposed on microprint substrate 208 prior to glassy composite 207 being disposed on microprint substrate 208, wherein glassy composite 207 is disposed on native moiety 211 or on both microprint substrate and native moiety. Native moiety 211 can remain or subsequently be removed from microprint substrate 208 after removal of glassy transfer layer 206 from microprint substrate 208.

Figure 15:
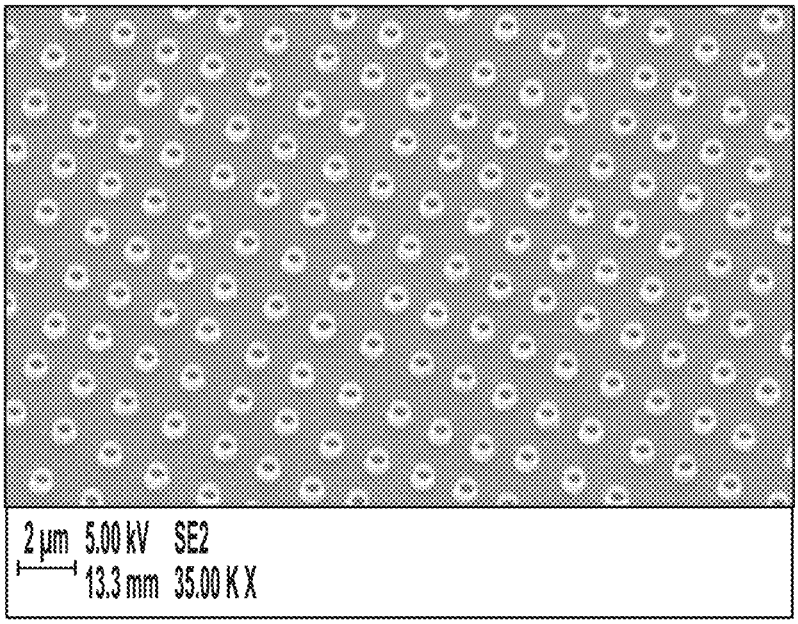
FIG. 15 shows hollow cylinders disposed on a planar microprint substrate in panel A and hollow cylinders disposed on a sphere in panel B.
Figure 15:
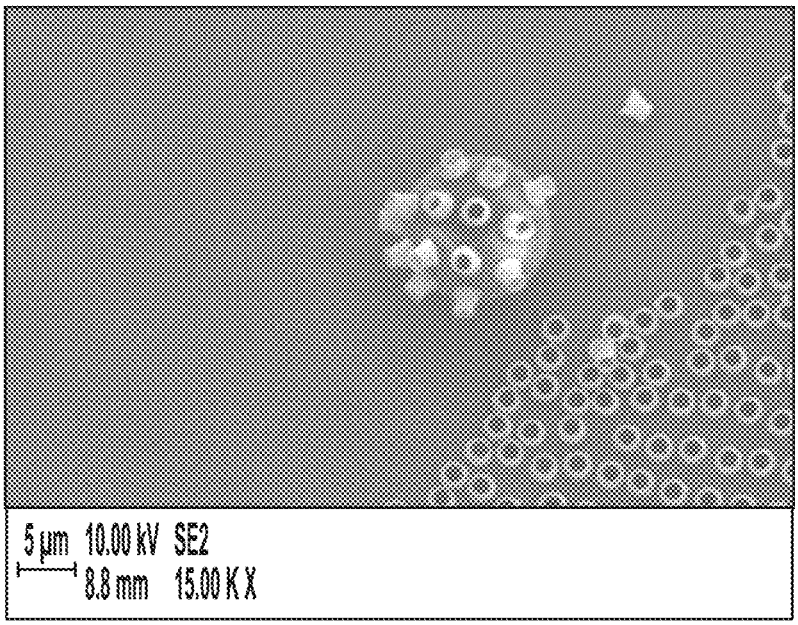
Figure 16:
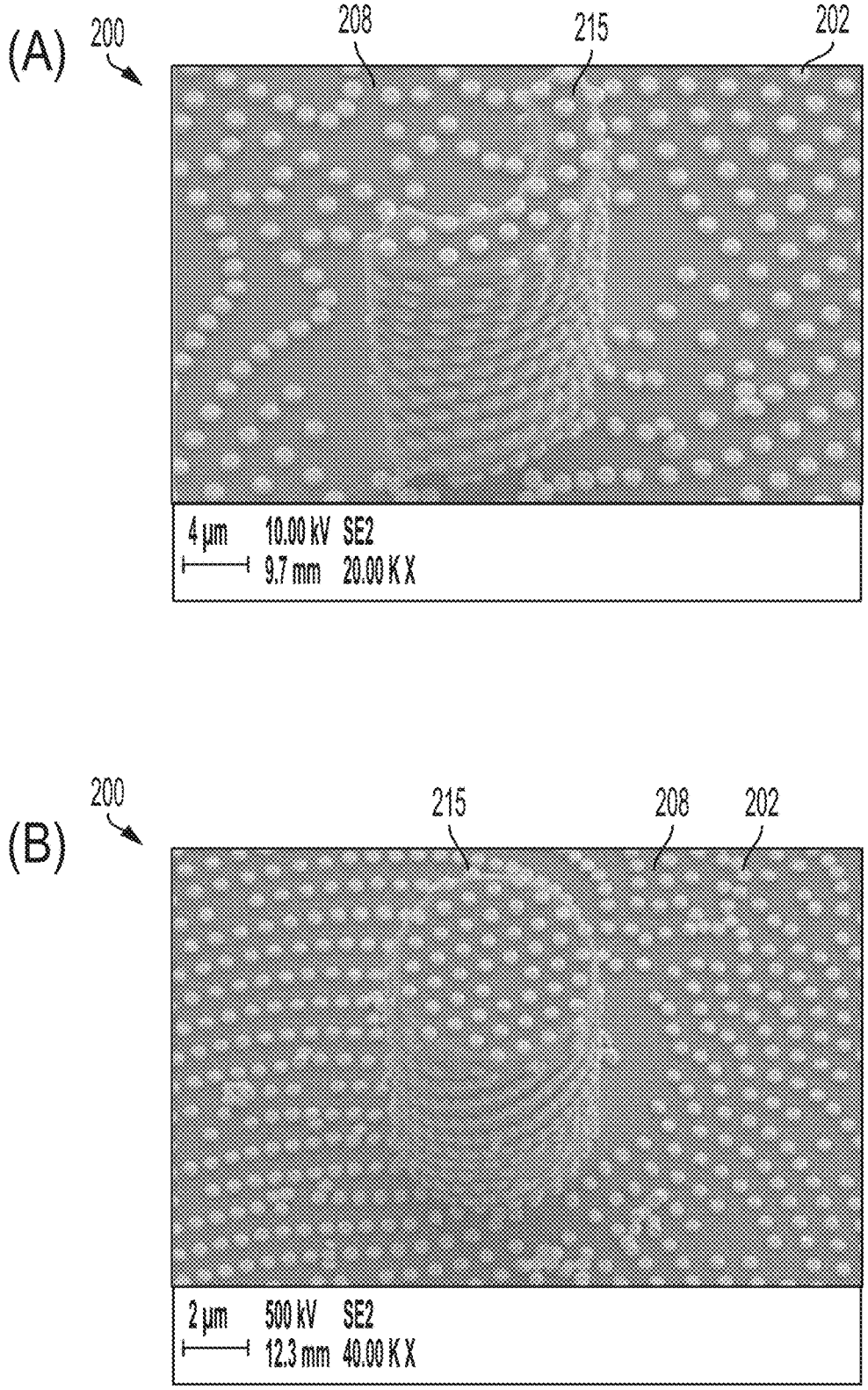
FIG. 16 shows metallic dots as transfer moieties on a microprint substrate that includes a sharp right-angled protuberance extending from a surface of the microprint substrate in panel A for an arc-shaped protuberance and panel B for a cylinder-shaped protuberance.
Figure 17:
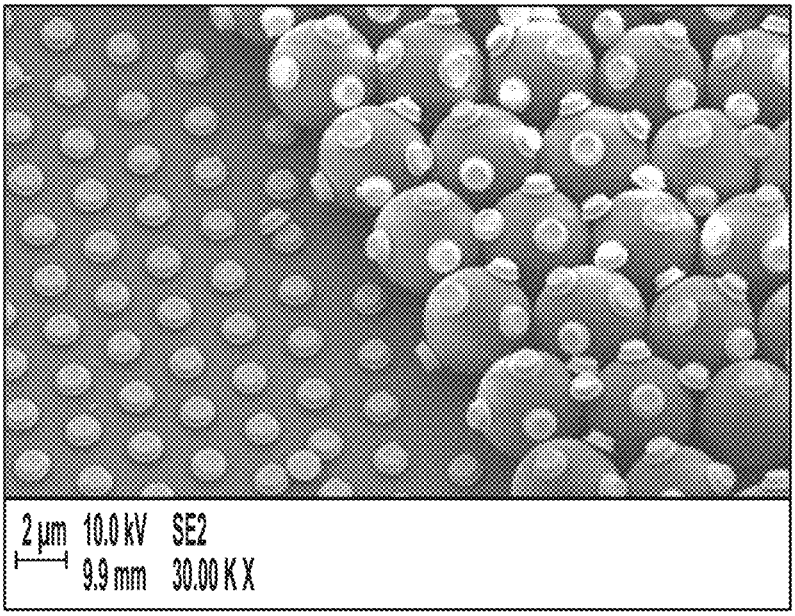
FIG. 17 shows metallic dots as transfer moieties on a microprint substrate that includes a planar surface and a plurality of native moieties arranged in an array in panel A and a zoomed view of a local cluster of such native moieties in panel B.
Figure 17:
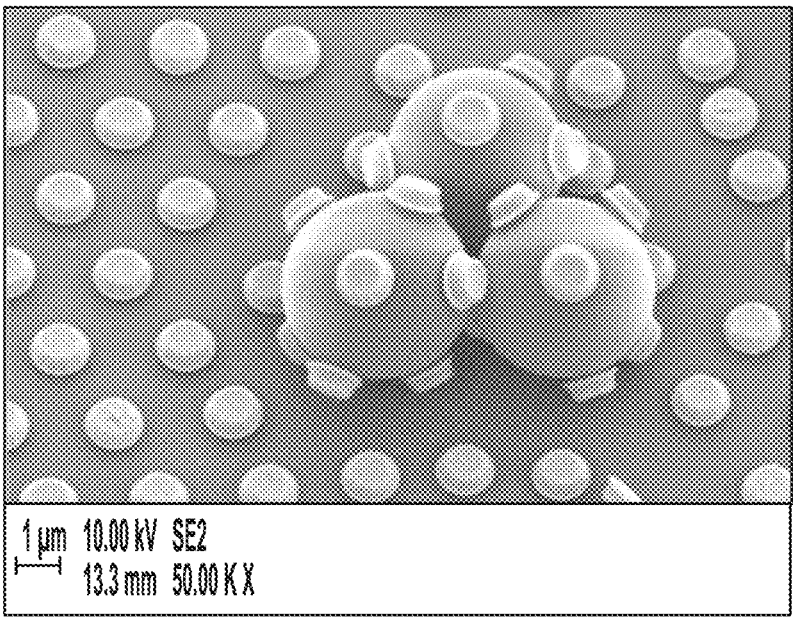
Figure 18:
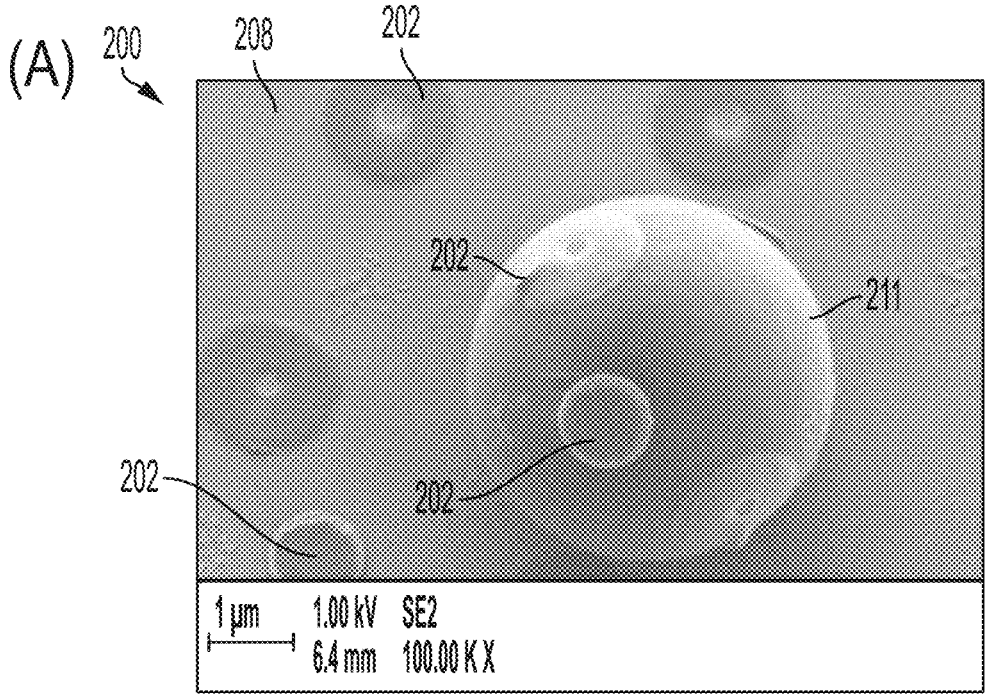
FIG. 18 shows metallic dots that include different metals and different shapes including gold disks and nickel annular rings as transfer moieties on a microprint substrate and disposed on a spherical native moiety in panel A and a zoomed out view of such in panel B.
Figure 18:
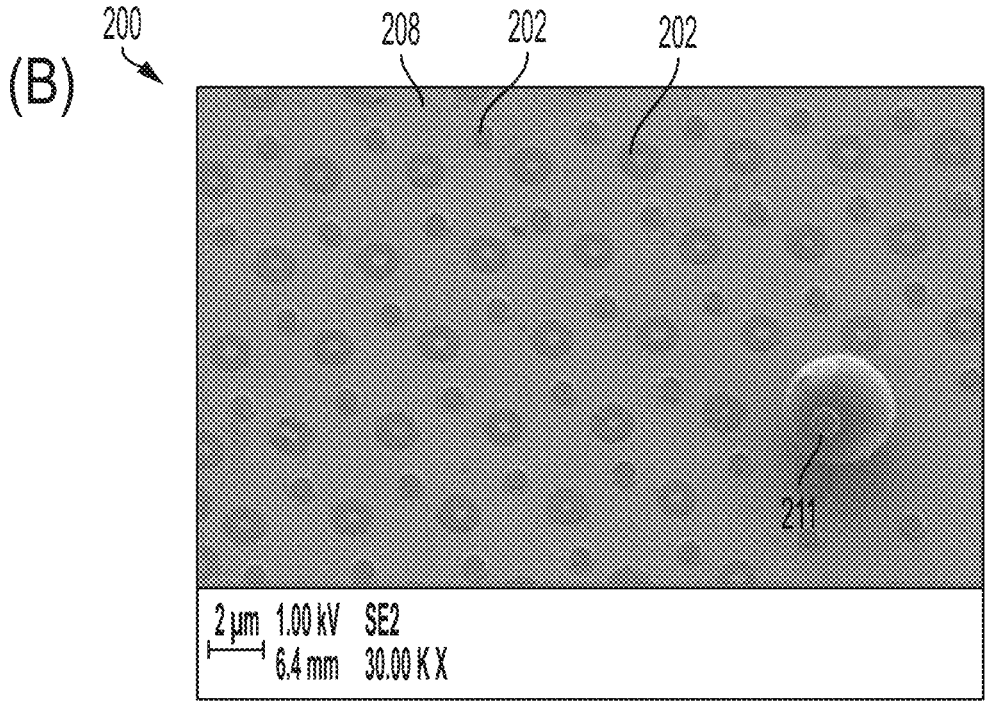

Native moiety 211 can include various materials, e.g., silicon, or other semiconductors, metals, glass, ceramic, paper, plastics or other flexible polymeric materials, textiles, fibers, biological materials such as skin, hair, tissue, organs and cells and the like. Exemplary native moieties 211 include microspheres, wires, optical fibers or components, electronic components. Native moiety 211 can have an arbitrary shape and size. It is contemplated that the shape of native moiety 211 can be round, polygonal, irregular, and the like to provide a cross-sectional shape this is symmetric or asymmetric with a selected degree of anisotropy. Further, native moiety 211 can be electrically insulating, semiconductive, or conductive. In an embodiment, native moieties 202 are magnetic, ferromagnetic, paramagnetic, nonmagnetic, or a combination thereof. A largest dimension of native moiety 211 can be from 1 nm to 1 cm, specifically from 10 nm to 1 mm, and more specifically from 100 nm to 100 micron. Moreover, native moiety 211 can have curvatures too extreme to be coated using conventional transfer materials, and native moiety geometry can include overhangs or undercuts that can be contacted with a reflowable transfer material. In an embodiment, native moiety 211 includes polystyrene microspheres of 4.5 micrometer diameter (see e.g., FIGS. 15,17,18).

Depending on a geometry of microprint substrate 208, heating glassy composite 207 on microprint substrate 208 can be conducted under a vacuum or partial vacuum environment to remove trapped air pockets in recessed regions, e.g., trench 212 or blind hole 214, of microprint substrate 208 that could prevent glassy composite 207 from fully flowing in trench 212 or blind hole 214.

In an embodiment, glassy transfer layer 206 is disposed on microstructure 210 that is disposed on sacrificial layer 203 by placing a solid piece of glassy transfer layer 206 on microstructure 210 and heating glassy transfer layer 206 to reflow and contact microstructure 210 to form glassy composite 207 on sacrificial layer 203. In an embodiment, forming glassy composite 207 on sacrificial layer 203 includes solvating glassy transfer layer 206 in a second solvent to form a liquid composition for disposal on microstructure 210 on sacrificial layer 203; forming a temporary containment barrier around a periphery of sacrificial layer 203 on which is disposed microstructure 210; and pouring dissolved glassy transfer layer 206 on microstructure 210 and sacrificial layer 203. The temporary containment barrier keeps glassy transfer layer 206 from flowing off of sacrificial layer 203 and can be, e.g., a material that is wrapped around a periphery of sacrificial layer 203. The second solvent used to solvate glassy transfer layer 206 can evaporated by heating glassy composite 207, or flowing a gas over sacrificial layer 203 to increase evaporation of the second solvent from glassy composite 207 on sacrificial layer 203, or waiting long enough for evaporation of the second solvent from glassy composite 207. In the case of heat assisted evaporation, the glassy composite can be allowed to cool slowly to avoid possible cracking.

Forming glassy composite 207 on sacrificial layer 203 alternatively can include a drop of liquid composition for glassy transfer layer 206 that can be spin-coated over microstructure 210 on microprint substrate 208 or solid glassy transfer layer 206 can be heated to soften glassy transfer layer 206 but not liquify it and with subsequent mechanical pushing or stretching glassy transfer layer 206 can be spread over microstructure 210 on sacrificial layer 203.

The process for making ultra-conformal microprint 200 also can include a transfer substrate that is itself non-planar since the glassy transfer layer can be made to ultra-conformally coat the transfer substrate and the transfer moieties just as it can ultra-conformally coat the microprint substrate. A spatially patterned transfer substrate that may have deliberately fashioned local embossed or recessed regions would create an inversely patterned glass transfer layer that could then be used to selectively transfer print only onto certain regions of the microprint substrate, corresponding to those regions where the embossed sections of the transfer layer make contact with the microprint substrate. To ensure ultra-conformal contact only for those embossed regions the glassy layer can be heated to near to its glass transition temperature such that it only partially reflows onto the microprint substrate around the embossed contact regions.

Glassy transfer layer 206 can include various materials, e.g., a carbohydrate, an amorphous agent, an additive, and the like. Exemplary carbohydrates include a sugar such as sucrose, corn syrup, and the like. Exemplary amorphous agents include a water soluble polymer such as starch, including corn starch. Exemplary additives include fat, trans fat, protein, carboxylic acid (e.g., malic acid, citric acid, acetic acid, fumaric acid, lactic acid, tartaric acid and the like), gelatin, emulsifier, stabilizer, thickener, anticaking agent, preservative, antioxidant, leavening agent, acidulant (e.g., phosphoric acid, and the like), and the like. In an embodiment, glassy transfer layer 206 includes sucrose and corn syrup. Corn syrup can be made from starch and can include maltose or higher oligosaccharides. Without wishing to be bound by theory, it is believed that the corn syrup prevents crystallization of the sugar in glassy transfer layer 206. A relative amount of sugar in the corn syrup is selected to provide glassy transfer layer 206 with a glass transition temperature Tg and arbitrary range of viscosity, wherein glass transition temperature Tg of glassy transfer layer 206 provides gradual and reversible transition as an amorphous material so that glassy transfer layer 206 transitions from a hard and brittle glassy state into a viscous or rubbery state and finally a low viscosity liquid as a temperature of glassy transfer layer 206 increases. In this respect, glass transition temperature Tg of glassy transfer layer 206 can be from 1° C. to 200° C., specifically from 10° C. to 150° C., and more specifically from 25° C. to 100° C.

Glassy transfer layer 206 can have an arbitrary shape and size. It is contemplated that the shape of glassy transfer layer 206 can be round, polygonal, irregular, and the like to provide a cross-sectional shape this is symmetric or asymmetric with a selected degree of anisotropy. A surface of glassy transfer layer 206 can be planar or curved and can have a recessed or embossed feature such as an aperture, hole, trench, post, ridge and the like, wherein the recessed or embossed feature can have an arbitrary largest linear dimension and arbitrary shortest linear dimension along a radius, length, width, or height of the recessed feature, as applicable to a geometry of the glassy transfer layer 206. A largest dimension of glassy transfer layer 206 can be from 1 micron to 10 m, specifically from 100 micron to 1 m, and more specifically from 1 mm to 10 cm. Further, if a thin glassy transfer layer 206 is used, a temporary surrounding or backing material such as, e.g. tape could be temporarily attached to the glass transfer layer to add mechanical stability or provide a convenient method of holding the glass transfer layer when the glass transfer layer is transferred from transfer substrate to microprint substrate. In an embodiment, glassy transfer layer 206 includes a caramelized sugar and corn syrup mixture. In another embodiment, glass transfer layer includes a commercial Jolly Ranchers hard candy, including all incorporated colorings, scents, flavorings and additives dissolved in water and then solidified on transfer substrate.

Glassy composite 207 is formed by disposing transfer moiety 202 in glassy transfer layer 206, wherein glassy composite 207 can have an arbitrary shape and size in which glassy transfer layer 206 in glassy composite 207 conforms to a shape of transfer substrate 201 sacrificial layer 203, and transfer moiety 202 thereon. It is contemplated that the shape of glassy composite 207 can be round, polygonal, irregular, and the like to provide a cross-sectional shape this is symmetric or asymmetric with a selected degree of anisotropy. A surface of glassy composite 207 can be planar or curved and can have a recessed or embossed feature such as an aperture, hole, trench, post, ridge and the like, wherein the recessed or embossed feature can have an arbitrary largest linear dimension and arbitrary shortest linear dimension along a radius, length, width, or height of the recessed feature, as applicable to a geometry of the glassy composite 207. A largest dimension of glassy composite 207 can be from 100 nm to 10 m, specifically from 1 micron to 1 m, and more specifically from 1 mm to 10 cm. In an embodiment, glassy composite 207 includes a sugar and corn syrup mixture with an array of gold microdisks embedded in its surface.

It is contemplated that sacrificial layer 203 is miscible in a first solvent, and glassy transfer layer 206 is miscible in a second solvent for which the microprint substrate 208 and the transfer moiety 202 are immiscible. The first solvent can include an organic solvent, e.g., acetone, toluene, benzene, and the like. The second solvent can include a water, an alcohol (e.g., methanol, ethanol, and the like), and the like.

Transfer substrate 201 receives sacrificial layer 203 or microstructure 210. Transfer substrate 201 can include various materials, e.g., silicon or other semiconductors, metals, glass, quartz, plastics or other polymeric materials, and the like. Exemplary transfer substrates 201 include substrates on which the transfer moieties can be readily fabricated such a silicon or glass or quartz or polymeric materials. Transfer substrate 201 can have an arbitrary shape and size. It is contemplated that the shape of transfer substrate 201 can be round, polygonal, irregular, and the like to provide a cross-sectional shape this is symmetric or asymmetric with a selected degree of anisotropy. A surface of transfer substrate 201 can be planar or curved and can have a recessed or embossed feature such as an aperture, hole, trench, post, ridge and the like, wherein the recessed or embossed feature can have an arbitrary largest linear dimension and arbitrary shortest linear dimension along a radius, length, width, or height of the recessed feature, as applicable to a geometry of the transfer substrate 201. A largest dimension of transfer substrate 201 can be from 1 micron to 10 m, specifically from 100 micron to 1 m cm, and more specifically from 1 mm to 10 cm. In an embodiment, transfer substrate 201 includes a 3" silicon wafer.

Further, because of the ability to controllably soften the glassy transfer layer by raising its temperature to near to its glass transition such that it is either flexible or flowable, the ultra-conformal process herein is compatible with roll-to-roll manufacturing techniques. With transfer moieties disposed on one layer of material that is wound round one roll, the glassy transfer layer can be applied by pressing or rolling that roll into or over the softened glassy transfer material, or by rolling the roll such that the transfer substrate and transfer moieties thereon pass through a trough containing a liquefied version of the glassy transfer material which then solidifies onto the rolled material as it emerges from the liquid in the trough and subsequently cools, or as any solvent in the liquefied glassy transfer material evaporates. The glassy transfer material can be transferred via rolling contact pressure onto a second roll around which is wound a flexible microprint substrate which is subsequently passed through a trough of solvent that dissolves away the glassy transfer layer leaving the transfer moieties in their microstructure on the microprint substrate that is then fed off the second roll.

Depending on a design, ultra-conformal microprint transferring can include additional roller steps. In a roll-to-roll process, a largest dimension of either the transfer substrate, glassy transfer later, transfer moieties and their microstructure, glassy composite, or microprint substrate is arbitrarily selectable, i.e., no upper limit on size is discernable.

Ultra-conformal microprint 200 has numerous advantageous and unexpected benefits and uses including placing electronic, magnetic, conductive, optical, or other components into surface regions that would not otherwise be readily, or economically, accessible. The process for making ultra-conformal microprint 200 can be used in applications involving flexible electronics such as wearable sensors to transfer electronic patterns onto a flexible substrate. Because ultra-conformal microprint transferring can use water as the second solvent to remove away glassy transfer layer 206 from microprint substrate 208 at room temperature under ambient conditions, ultra-conformal microprint transferring can directly or indirectly transfer print microstructure 210 onto a biological surface, including tissues, cells, muscles, bones, skin, and the like.

Ultra-conformal microprint transferring can ultra-conformally cover surfaces of high curvature, and ultra-conformal microprint transferring can transfer print metallic or non-metallic patterns as microstructure 210 around optical fibers, providing spectral control of fiber-guided light propagation and fiber optic sensing through interactions between transferred patterns microstructure 210 on microprint substrate 208 and conditions in a surrounding medium. Ultra-conformal microprint transferring can transfer periodic arrays of patterns as microstructure 210 to transfer print diffraction gratings onto other optical elements that can be transmissive or reflective or onto planar or curved surfaces of microprint substrate 208. Arrays can include patterned structures of microstructure 210 that are optical or microwave metasurfaces, which can be transferred onto different surfaces for optical control. Patterns of magnetic elements as microstructure 210 can be transferred to provide magnetic control over surfaces of microprint substrate 208, which might include flexible surfaces or thin fibers, providing ultra-conformal microprint 200 to be magnetically guided, bent, twisted, and the like. Metallic patterns of microstructure 210 can be ultra-conformally transferred to pattern RF antennae on novel-shaped surfaces of microprint substrate 208.

It is contemplated that ultra-conformal transferring of arrays of metallic islands or grids of metallic wires as microstructure 210 can be wrappedly disposed around surfaces (e.g., microelectronic components) of microprint substrate 208 to provide a local Faraday cage RF shield. Microstructure 210 can be subjected to ultra-conformal microprint transferring onto microprint substrate 208 to provide microprint substrate 208 with properties such as anti-reflection, thermal or wetting properties, or decreased radar detection.

Advantageously, ultra-conformal microprint transferring solves conventional problems of micropatterning on highly curved surfaces. Ultra-conformal microprint transferring can form microstructure 210 on microprint substrate 208 where transfer printing is desirable but under which direct printing onto microprint substrate 208 by conventional means is infeasible due to processing conditions that could destroy or adversely impact microprint substrate 208 or microstructure 210. Such conventional conditions can include processing temperature; chemical exposure; shape, size, surface flatness, material hardness, surface roughness, surface optical property requirements of processing tools, vacuum processing, thermal expansion mismatches, and the like. Ultra-conformal microprint transferring can be used for transferring microstructure 210 such as electronics for heads-up displays onto windshields, helmet visors, glasses, and the like such that, e.g., map or text data can be displayed thereon. Ultra-conformal microprint transferring can be used for transferring functional layers as microstructure 210 on microprint substrate 208 that can include a consumer object such as a cell phone, pen, and the like. Ultra-conformal microprint transferring can be used for transferring optical or holographic micropatterns as microstructure 210 on microprint substrate 208 that can include drugs to prevent counterfeits.

Ultra-conformal microprint transferring can use water as the second solvent at room temperature. Ultra-conformal microprint transferring is gentle on microprint substrate 208, providing repetition of ultra-conformal microprint transferring to build layers of patterned materials and structures, or allowing the transferred structures to be used to guide further processing on the microprint substrate by ultra-conformal microprint transferring a stencil mask, for example, onto the microprint substrate.

Beneficially, ultra-conformal microprint transferring can be used for deformation of microstructure 210 before being disposed on microprint substrate 208 by heating glassy composite 207 to near glass transition temperature Tg of glassy transfer layer 206. In this manner, an array as microstructure 210 can have a selected periodicity, wherein the periodicity subsequently can be changed before glassy composite 207 is disposed on microprint substrate 208. In an embodiment, a diffraction grating pattern of wires as microstructure 210 can be stretched in glassy composite 207 to change effective diffraction angles of microstructure 210 in glassy composite 207, or such grating or other metamaterial patterning could be locally stretched or twisted to locally impart different optical properties before glassy composite 207 is disposed on microprint substrate 208. As a result, ultra-conformal microprint transferring is efficient and can allow complex patterns to be created in an absence of complex processing equipment.

In contrast to conventional transfer printing techniques, ultra-conformal microprint transferring prints micropatterns around surfaces with very tight radii of curvature, sharp corners, undercuts, holes, protrusions, uneven surfaces, and rough surfaces. Ultra-conformal microprint transferring involves glassy composite 207 that can reflow, stretch, or deform on microprint substrate 208, wherein glassy composite 207 ultra-conformally matches surfaces of microprint substrate 208 having high curvature or tight radii.

The articles and processes herein are illustrated further by the following Example, which is non-limiting.

EXAMPLE

Various ultra-conformal microprints 200 were made by ultra-conformal microprint transferring. Here, ultra-conformal microprint transferring included an initial silicon wafer substrate that was first spin coated with a photoresist layer to be used as a sacrificial layer. This photoresist layer was partially hard-baked so that it would not subsequently dissolve in photoresist developer but would still dissolve in acetone. It was also coated with a thin passivating layer, for example, by exposure to reactive $C_4F_8$ gas to yield a thin per-fluorinated coating, to prevent subsequent dissolution in photoresist solvent that was present in a second layer of photoresist that was subsequently spin coated over this first layer of photoresist. The second layer of photoresist was then patterned via optical lithography and those regions that were exposed to the light were then developed away in photoresist developer to leave behind a photoresist stencil mask. The stencil mask was fully exposed to the light so that it was subsequently dissolved away in photoresist developer.

Metals that formed the transfer moieties were evaporated onto this substrate, and the residual photoresist including the stencil mask was then removed through being developed away in photoresist developer that also removed deposited metal that was coating it. This left behind metal patterns only in the positions and geometries of the holes of the stencil mask on the sacrificial photoresist layer, forming the desired transfer moieties in the desired microstructure. This was then coated by pouring a sugar-corn syrup glassy material over it and the solvent (in this case water) was evaporated from the glassy material by heating. The substrate was then placed in acetone to dissolve away the sacrificial photoresist layer and separate the glassy composite containing the transfer moieties in the microstructure, which was then placed onto various microprint substrates that had been prepatterned with demonstrative surface features or native moieties. To achieve ultra-conformal coating, this glassy composites on the microprint substrates were then gently heated to allow for reflow of the glassy transfer material, which reflowed together with the embedded transfer moieties over the microprint substrate. After dissolution of the glassy transfer material in water, the transfer moieties in their microstructure remained behind on the microprint substrates. Scanning electron microscope images of ultra-conformal microprints 200 that were made according to this procedure are shown in FIG. 13, FIG. 14, FIG. 15, FIG. 16, FIG. 17, and FIG. 18, showing microstructure 210 formed on various shaped microprint substrates 208.

While one or more embodiments have been shown and described, modifications and substitutions may be made thereto without departing from the spirit and scope of the invention. Accordingly, it is to be understood that the present invention has been described by way of illustrations and not limitation. Embodiments herein can be used independently or can be combined.

All ranges disclosed herein are inclusive of the endpoints, and the endpoints are independently combinable with each other. The ranges are continuous and thus contain every value and subset thereof in the range. Unless otherwise stated or contextually inapplicable, all percentages, when expressing a quantity, are weight percentages. The suffix "(s)" as used herein is intended to include both the singular and the plural of the term that it modifies, thereby including at least one of that term (e.g., the colorant(s) includes at least one colorants). "Optional" or "optionally" means that the subsequently described event or circumstance can or cannot occur, and that the description includes instances where the event occurs and instances where it does not. As used herein, "combination" is inclusive of blends, mixtures, alloys, reaction products, and the like.

As used herein, "a combination thereof" refers to a combination comprising at least one of the named constituents, components, compounds, or elements, optionally together with one or more of the same class of constituents, components, compounds, or elements.

All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." It should further be noted that the terms "first," "second," "primary," "secondary," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity). The conjunction "or" is used to link objects of a list or alternatives and is not disjunctive; rather the elements can be used separately or can be combined together under appropriate circumstances.

What is claimed is:

1. A process for making an ultra-conformal microprint 200 by ultra-conformal microprint transferring, the process comprising:

disposing a transfer moiety 202 arranged in a microstructure 210 on transfer substrate 201;

disposing a glassy transfer layer 206 on the transfer moiety 202;

forming a glassy composite 207 comprising the glassy transfer layer 206 and transfer moiety 202 with maintaining the microstructure 210 of the transfer moiety 202 in the glassy transfer layer 206;

removing the glassy composite 207 from the transfer substrate 201 while maintaining the microstructure 210 of the transfer moiety 202 in the glassy transfer layer 206;

disposing the glassy composite 207 on a microprint substrate 208;

ultra-conformally covering the microprint substrate 208 with the glassy composite 207 while maintaining the microstructure 210 of the transfer moiety 202 in the glassy transfer layer 206 so that the microstructure 210 is disposed on the microprint substrate 208; and removing the glassy transfer layer 206 by dissolving the glassy transfer layer while leaving the transfer moiety 202 disposed in the microstructure 210 on the microprint substrate 208 to form the ultra-conformal microprint 200 comprising the transfer moiety 202 arranged in the microstructure 210 on the microprint substrate 208.

2. The process of claim 1, further comprising:

forming a sacrificial layer 203 on the transfer substrate 201 prior to disposing the transfer moiety 202 and the glassy transfer layer 206 on the transfer substrate 201;

disposing the transfer moiety 202 arranged in the microstructure 210 on the sacrificial layer 203; and forming the glassy composite 207 on the sacrificial layer 203 to form the glassy composite 207 on the sacrificial layer 203 such that the sacrificial layer 203 is interposed between the transfer substrate 201 and the glassy transfer layer 206.

3. The process of claim 2, further comprising:

removing the sacrificial layer 203 to separate the glassy composite 207 from the transfer substrate 201 prior to removing the glassy composite 207 from the transfer substrate 201 while maintaining the microstructure 210 of the transfer moiety 202 in the glassy transfer layer 206.

4. The process of claim 3, further comprising:

contacting the sacrificial layer 203, while disposed on the transfer substrate 201, with a first solvent that removes the sacrificial layer 203 to separate the glassy composite 207 from the transfer substrate 201, wherein the glassy transfer layer 206 is immiscible in the first solvent.

5. The process of claim 4, further comprising:

contacting the glassy transfer layer 206, while disposed on the microprint substrate 208, with a second solvent that removes the glassy transfer layer 206 from the microprint substrate 208 and leaves the transfer moiety 202 disposed in the microstructure 210 on the microprint substrate 208.

6. The process of claim 1, further comprising:

heating the glassy transfer layer 206 to flow the glassy transfer layer 206 onto the microstructure 210 to form the glassy composite 207 on the transfer substrate 201.

7. The process of claim 1, further comprising:

heating the glassy composite 207 to flow the glassy transfer layer 206 with the transfer moiety 202 on the microprint substrate 208 to ultra-conformally cover the glassy composite 207 on the microprint substrate 208.

8. The process of claim 1, wherein the glassy transfer layer 206 has a glass transition temperature.

9. The process of claim 8, wherein the glass transition temperature of the glassy transfer layer 206 is from 1° C. to 50° C.

10. The process of claim 1, wherein the glassy transfer layer 206 is miscible in a second solvent for which the microprint substrate 208 and the transfer moiety 202 are immiscible.

11. The process of claim 10, wherein the second solvent that the glassy transfer layer 206 is miscible comprises water.

12. The process of claim 1, wherein the transfer moiety 202 comprises a largest linear dimension that is less than 1 μm.

* * * * *